US009799448B2

(12) United States Patent
Wang

(10) Patent No.: US 9,799,448 B2
(45) Date of Patent: Oct. 24, 2017

(54) INDUCTOR, TRANSFORMER, AND METHOD

(71) Applicant: James Jen-Ho Wang, Phoenix, AZ (US)

(72) Inventor: James Jen-Ho Wang, Phoenix, AZ (US)

(73) Assignee: Power Gold LLC, Phoenix, AZ (US)

( * ) Notice: Subject to any disclaimer, the term of this patent is extended or adjusted under 35 U.S.C. 154(b) by 0 days.

(21) Appl. No.: 14/505,474

(22) Filed: Oct. 2, 2014

(65) Prior Publication Data

US 2016/0163451 A1 Jun. 9, 2016

Related U.S. Application Data

(60) Provisional application No. 61/886,061, filed on Oct. 3, 2013.

(51) Int. Cl.
*H01F 27/29* (2006.01)
*H01F 41/04* (2006.01)
*H01F 27/28* (2006.01)

(52) U.S. Cl.
CPC ..... *H01F 41/042* (2013.01); *H01F 27/2804* (2013.01); *H01F 27/29* (2013.01)

(58) Field of Classification Search
CPC .... H01F 5/00; H01F 27/00–27/30; H01F 7/06
USPC ..... 336/65, 200, 232; 29/602.1
See application file for complete search history.

(56) References Cited

U.S. PATENT DOCUMENTS 6,175,293 B1 * 1/2001 Hasegawa ..... H01F 1/15308 336/150
8,692,642 B2 * 4/2014 Singh ..... H01F 41/00 336/200
2006/0290460 A1 * 12/2006 Waffenschmidt ..... H05K 1/165 336/223
2013/0200976 A1 * 8/2013 Singh ..... A61N 1/0553 336/185

* cited by examiner

*Primary Examiner* — Tuyen Nguyen
(74) *Attorney, Agent, or Firm* — Edward James Mischen

(57) ABSTRACT

In accordance with an embodiment, a circuit element includes a flexible foldable substrate having portions of a first inductor formed on first and second major surfaces of the flexible substrate. In accordance with another embodiment, a first electrically conductive trace having a first terminal, a second terminal, and a first annular-shaped portion between the first terminal and the second terminal is formed on a first portion of the first major surface. A second electrically conductive trace having a first terminal, a second terminal, a first annular-shaped portion between the first terminal and the second terminal of the second electrically conductive trace, and a second annular-shaped portion between the first terminal and the second terminal of the second electrically conductive trace is formed on the second major surface. The first electrically conductive trace is coupled to the second electrically conductive trace by a thru-via.

20 Claims, 13 Drawing Sheets

INDUCTOR, TRANSFORMER, AND METHOD

BACKGROUND

The present invention relates, in general, to electronics and, more particularly, to structures capable of storing energy and methods of manufacturing the structures.

Generally, energy storage elements store energy in a magnetic field or in an electrostatic field. In the past, the electronics industry has used inductors to store energy in an electromagnetic field. Discrete inductors are typically used to make transformers. For example, a pair of inductors can be wound around a common magnetic core to form the transformer, where one of the inductors serves as a primary inductor and the other inductor serves as a secondary inductor. These inductors are referred to as primary and secondary coils or primary and secondary windings. The ratio of the number of turns of the primary coil to the secondary coil is referred to as the turns ratio or the winding turns ratio of the transformer. The transformers can be configured to tap into different segments of the coils to select a desired turns ratio. It should be noted that the turns ratio can be set to be greater than one or less than one. A transformer with a turns ratio less than one may be referred to as a step-up transformer and a transformer with a turns ratio greater than one may be referred to as a step-down transformer. Although inductors and transformers are useful circuit structures, they have drawbacks including a large size, i.e., they are bulky, a limited frequency range, limitations in the ability to trim or adjust the coils or the inductors after being mounted to a structure such as, for example, a printed circuit board, and they are heavy.

Accordingly, it would be advantageous to have an energy storage element and a method for manufacturing energy storage elements that are adjustable, small, thin, bendable, and lightweight. It would be of further advantage for the structure and method to be cost efficient to implement.

BRIEF DESCRIPTION OF THE DRAWINGS

The present invention will be better understood from a reading of the following detailed description, taken in conjunction with the accompanying drawing figures, in which like reference characters designate like elements and in which.

Figure 1:
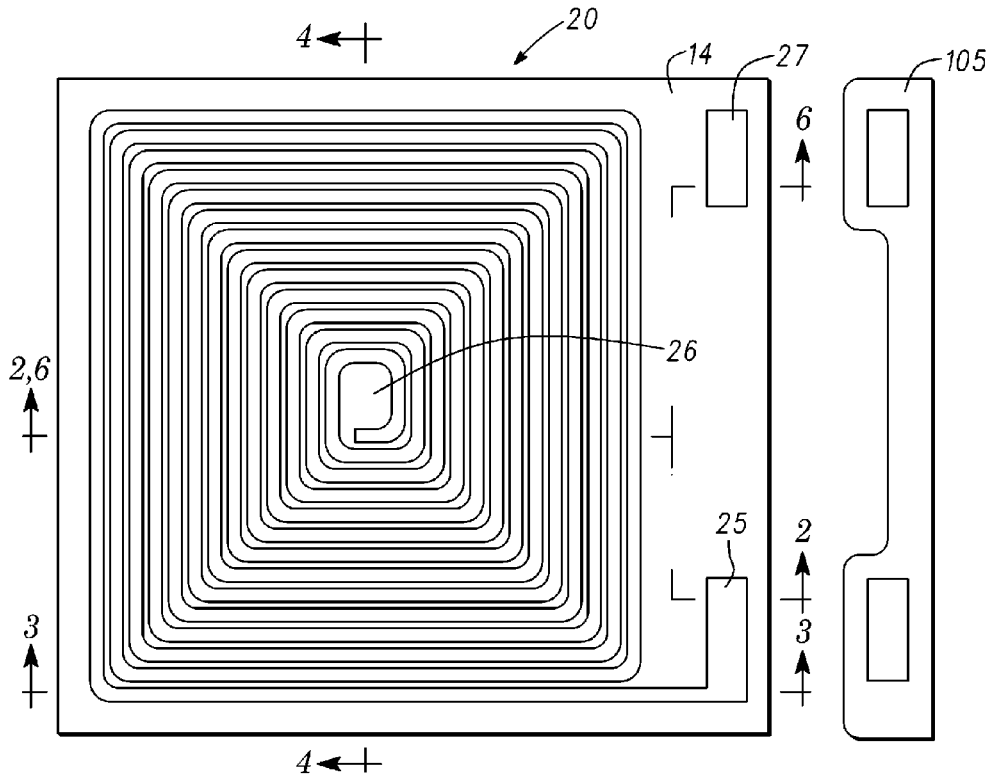
FIG. 1 is a top view of a film coil of an inductor in accordance with an embodiment of the present invention.

For simplicity and clarity of illustration, elements in the figures are not necessarily to scale, and the same reference characters in different figures denote the same elements. Additionally, descriptions and details of well-known steps and elements are omitted for simplicity of the description. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action. The use of the words approximately, about, or substantially means that a value of an element has a parameter that is expected to be very close to a stated value or position. However, as is well known in the art there are always minor variances that prevent the values or positions from being exactly as stated.

DETAILED DESCRIPTION

Generally inductors and transformers and methods for manufacturing the inductors and transformers are provided in accordance with embodiments of the present invention. In accordance with embodiments, the inductors and transformers are film coil inductors and field coil transformers. A plurality of small film coils are produced in a single panel. After testing, the panel is cut or singulated into film coils that may be stacked to form inductors and transformers. Other devices such as, for example, semiconductor devices, resistors, capacitors, or the like can be formed in or on the same film as the inductors. Incorporating semiconductor devices with the inductors has been described in PCT patent publication no. PCT/US2012/000259, titled FLEXIBLE CIRCUIT ASSEMBLY AND METHOD THEREOF, filed by James Jen-Ho Wang, which patent application is hereby incorporated herein by reference in its entirety.

Film coils and film transformers can be stacked onto one or both sides of the integrated film electronics to form variable inductors and variable transformers. In accordance with embodiments in which power transformers are formed, they can be positioned where noisy external AC (Alternating Current) power high voltage signals and associated electromagnetic interference are isolated and shielded from sensitive electronics embedded in the flexible films.

Figure 2:
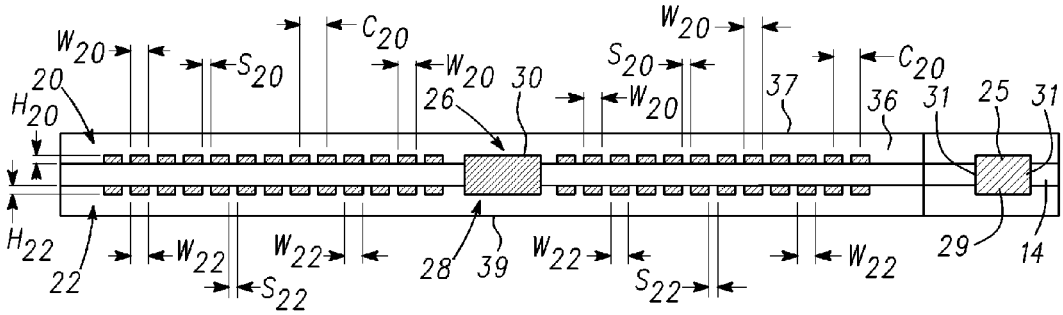
FIG. 2 is a cross-sectional view of the inductor of FIG. 1 taken along section line 2-2 of FIG. 1.
Figure 3:
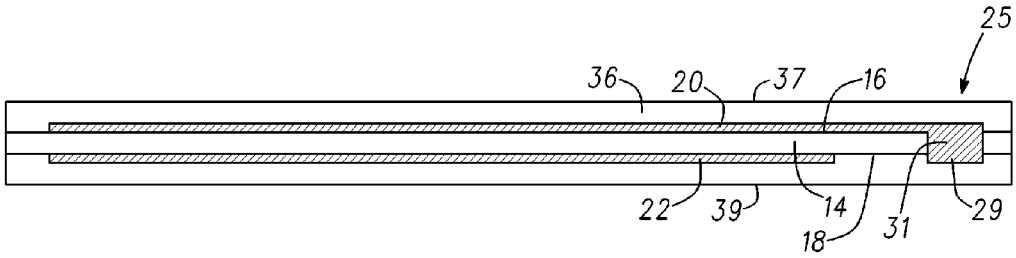
FIG. 3 is a cross-sectional view of the inductor of FIG. 1 taken along section line 3-3 of FIG. 1.
Figure 4:
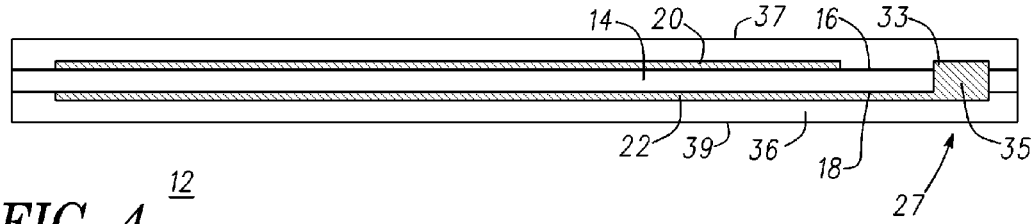
FIG. 4 is a cross-sectional view of the inductor of FIG. 1 taken along section line 4-4 of FIG. 1.

FIG. 1 is a top view of a film coil 20 of an inductor 12 in accordance with an embodiment of the present invention. FIG. 2 is a cross-sectional view of inductor 12 taken along section line 2-2 of FIG. 1. FIG. 3 is a cross-sectional view of inductor 12 taken along section line 3-3 of FIG. 1. FIG. 4 is a cross-sectional view of inductor 12 taken along section line 4-4 of FIG. 1. What is shown in FIG. 1 is film coil 20 formed on a Flexible Printed Circuit (FPC) substrate 14, wherein FPC substrate 14 has opposing surfaces 16 and 18. FIG. 2 shows a film coil 22 formed on surface 18 of FPC substrate 14. Suitable materials for FPC substrate 14 include polyimide, polytetrafluoroethylene, glass, polyester, liquid crystal polymer, diamond, ceramics such as, for example, barium zinc titanate (BZT), or the like. It should be noted that the thicknesses and types of polyimide films may be selected in accordance with the desired application. For example, adhesiveless polyimides operate up to temperatures of about 350 degrees Celsius (° C.), which offers less derating in response to operating in hot ambients, under water, and in harsh environments. In embodiments in which substrate 14 is polyimide, the thickness may range from about 6 micrometers to about 150 micrometers. A nominal thickness of polyimide is 25 micrometers (1 mil). A polyimide substrate may be referred to as a film.

Coil 20 having a terminal or an end 25 and a terminal or an end 26 is formed on surface 16 of FPC substrate 14 and coil 22 having a terminal or an end 27 and a terminal or an end 28 is formed on surface 18 of FPC substrate 14. By way of example, coils 20 and 22 are spiral shaped electrically conductive traces comprising thin layers of copper, wherein coil 20 is connected to coil 22 by means of a filled via 30. More particularly, end 26 is connected to end 28 through filled via 30 to form inductor 12. It should be noted that filled via 30 is comprised of a thru-via filled with an electrically conductive material. Because coils 20 and 22 are electrically connected together by filled via 30, they form an inductor structure that may be referred to as a film coil which may serve as inductor 12 or serve as a portion of inductor 12. The width $W_{20}$ of an electrically conductive trace of coil 20 may range from about 50 micrometers to about 2,500 micrometers, the height or thickness $H_{20}$ of the electrically conductive trace of coil 20 may range from about 1 micrometer to about 100 micrometers, the spacing $S_{20}$ between adjacent electrically conductive traces of coil 20 may range from about 5 micrometers to about 1,000 micrometers, and the center-to-center pitch $C_{20}$ between adjacent electrically conductive traces of coil 20 may range from about 10 micrometers to about 2,000 micrometers. In an example, spacing $S_{20}$ is about 35 micrometers and height $H_{20}$ is about 35 micrometers (1 ounce). In another example, spacing $S_{20}$ is about 35 micrometers and height $H_{20}$ is about 70 micrometers (2 ounces). The width $W_{22}$ of the electrically conductive trace of coil 22 may be different from width $W_{20}$ of the electrically conductive trace of coil 20 or they may be the same. Similarly, the height $H_{22}$ of the electrically conductive trace of coil 22 may be different from the height $H_{20}$ of the electrically conductive trace of coil 20 or they may be the same; and the center-to-center range of adjacent traces of coil 22 may be the same as the center-to-center range of adjacent traces of coil 20. In an example, spacing $S_{22}$ is about 35 micrometers and height $H_{22}$ is about 35 micrometers (1 ounce). In another example, spacing $S_{22}$ is about 71 micrometers and height $H_{22}$ is about 71 micrometers (2 ounces). Thus, the height, the width, the spacing, and the center-to-center pitch of coils 20 and 22 may be the same or they may be different. The material and dimensions of coils 20 and 22 are not limitations. Other suitable conductive materials for coils 20 and 22 include aluminum, graphite, permalloy, or the like. End 25 is connected to an electrically conductive pad 29 through a filled via 31, wherein filled via 31 is filled with an electrically conductive material. End 25 may be connected to another electrically conductive trace of a coil through connector 105. Alternatively, end 25 may be connected to another film inductor or to another circuit element using connector 105.

FIG. 3 further illustrates portions of coils 20 and 22, wherein end 25 of coil 20 is connected to electrically conductive pad 29 by filled via 31.

FIG. 4 further illustrates portions of coils 20 and 22, wherein end 27 of coil 22 is connected to electrically conductive pad 33 by filled via 35, wherein the material of filled via 35 is an electrically conductive material.

Figure 5:
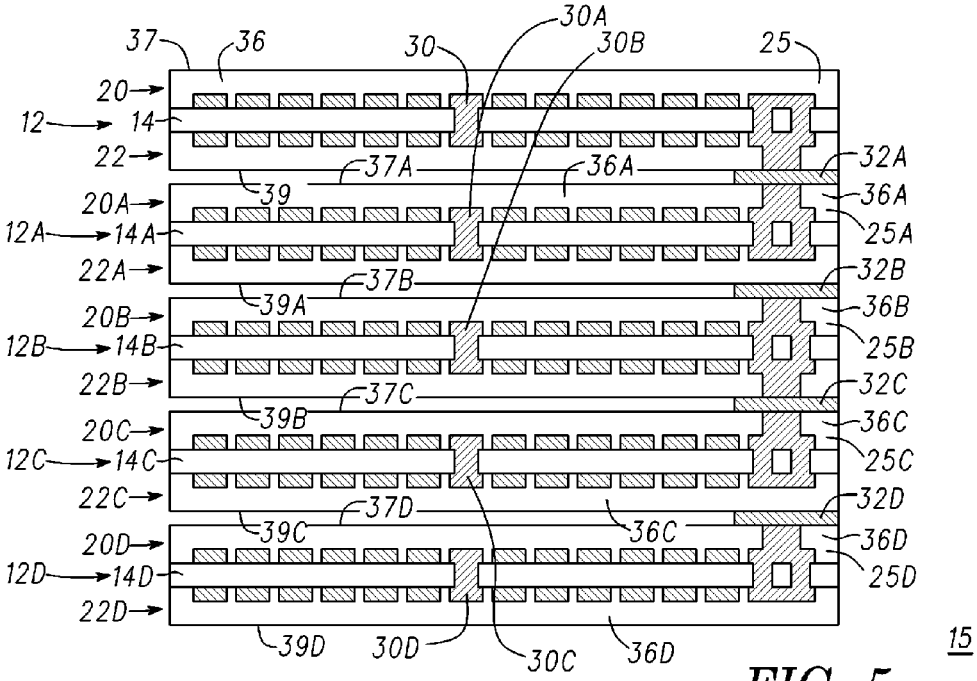
FIG. 5 is a cross-sectional view of a plurality of film coils configured to increase the inductance value of an inductor in accordance with another embodiment of the present invention.
Figure 6:
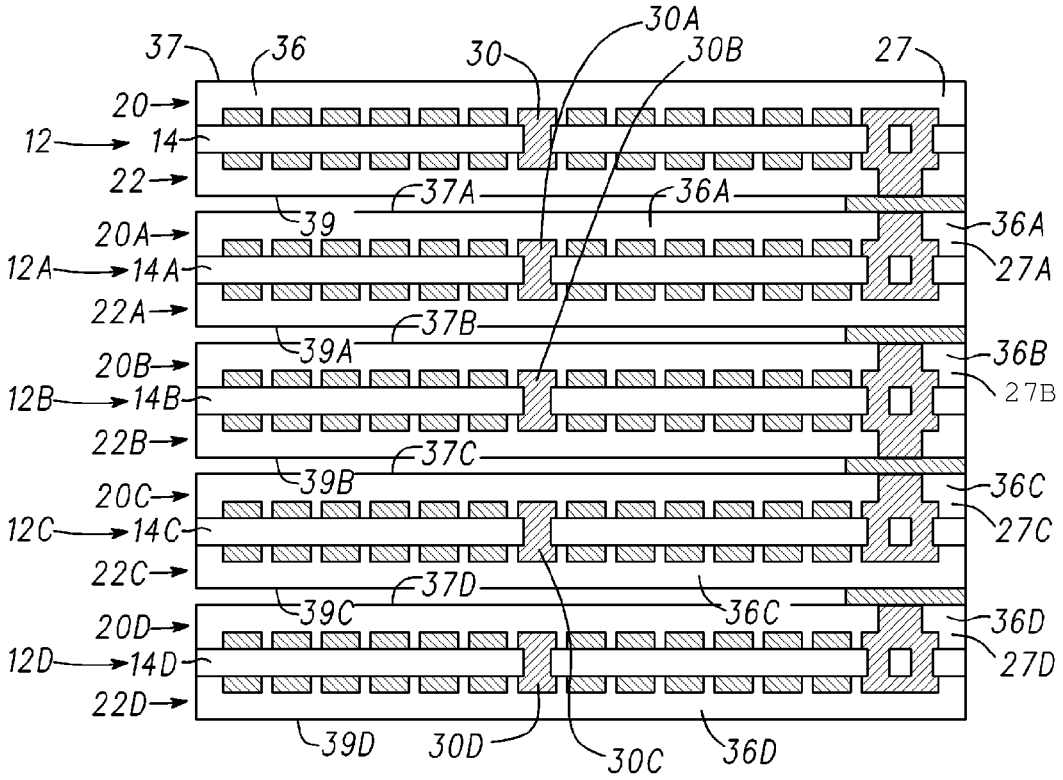
FIG. 6 is a cross-sectional view of a plurality of film coils configured to increase the inductance value of an inductor in accordance with another embodiment of the present invention.

FIGS. 5 and 6 are cross-sectional views of a plurality of film coils configured to form a higher inductance value inductor 15 in accordance with another embodiment of the present invention. What is shown in FIGS. 5 and 6 are a plurality of film coils 12, 12A, 12B, 12C, and 12D stacked over each other. It should be noted that reference characters A, B, C, and D have been appended to reference character 12 to distinguish the film coils. Thus, film coil 12 has ends 25 and 27; film coil 12A has ends 25A and 27A; film coil 12B has ends 25B and 27B; film coil 12C has ends 25C and 27C; and film coil 12D has ends 25D and 27D. End 25 of film coil 12 is connected to end 25A of film coil 12A and end 27 of film coil 12 serves as a terminal of inductor 15; end 27A of film coil 12A is connected to end 27B of film coil 12B and end 25B of film coil 12B is connected to end 25C of film coil 12C; end 27C of film coil 12C is connected to end 27D of film coil 12D and end 25D of film coil 12D serves as another terminal of inductor 15. Accordingly, film coils 12, 12A, 12B, 12C, and 12D are stackably connected together to form a continuous inductor coil. End 25 of film coil 12 is connected to end 25A of film coil 12A through a connector film 32A and end 25B of film coil 12B is connected to end 25C film coil 12C through a connector film 32B. Conductors films 32A, 32B, 32C, and 32D may be made from the same material as coils 20 and 22. FIG. 5 shows the inductors of film coils 12, 12A, 12B, 12C, and 12D aligned with each other to generate a maximum inductive coupling between the inductors of adjacent film coils, however this is not a limitation of the present invention. It should be noted that connectors such as connector 105 may connect different film coils, however these connectors may not be used in embodiments such as those shown in FIG. 14. In FIG. 1 connectors 105 provide flexibility in stacking and evaluating various coil designs. However, connector films may be soldered together or electrically connected using an Anisotropic Conductive Film (ACF) or an electrically conducting adhesive.

Referring to FIGS. 2 and 5, a protective material 36 is formed over surfaces 16 and 18 and coils 20 and 22, respectively The portion of protective material 36 over surface 16 and coil 20 has a surface 37 and the portion of protective material 36 over surface 18 and coil 22 has a surface 39. By way of example, protective material 36 is a photo-imageable polyimide having a thickness of about three micrometers. The material and thicknesses of protective material 36 are not limitations of the present invention. An opening is formed in protective material 36 to expose ends of coils 20 and 22 so that connector films may be soldered to the corresponding exposed ends of the coil through the opening. Connector films 32A-32D may be used to electrically connect a film coil to another film coil.

Figure 7:
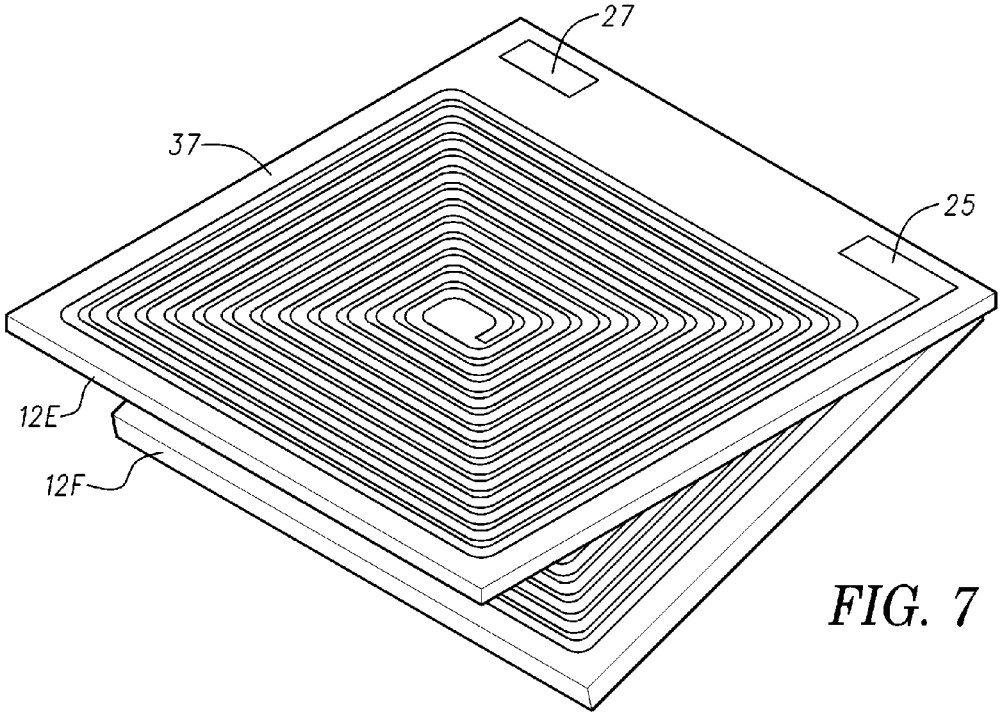
FIG. 7 is an isometric view of film coils stackably connected together to form a continuous inductor coil in accordance with another embodiment of the present invention.

FIG. 7 is a top view of film coils 12E and 12F stackably connected together to form a continuous inductor coil, wherein film coils 12E and 12F are offset or misaligned from each other. In accordance with this embodiment, film coils 12E and 12F are similar to film coil 12, however, reference characters E and F have been appended to reference character 12 to distinguish different film coils from each other. Film coils 12E and 12F are connected by a conductor film such as conductor film 32A, 32B, 32C, or 32D. Offsetting stacked film coils as shown in FIG. 6, decreases the inductive coupling between the inductor of film coil 12E and the inductor of film coil 12F, wherein the inductive coupling decreases in accordance with the amount of offset and how closely film coils 12E and 12F are vertically positioned from each other. Film coils 12E and 12F can be vertically spaced apart from each other by a magnetic material, a lubricant, a fluid, a non-magnetic film, or the like. Thus, the mutual inductance between vertically adjacent film coils can be adjusted by the choice of materials interposed between the film coils as well as the configuration of the individual film coils.

Figure 8:
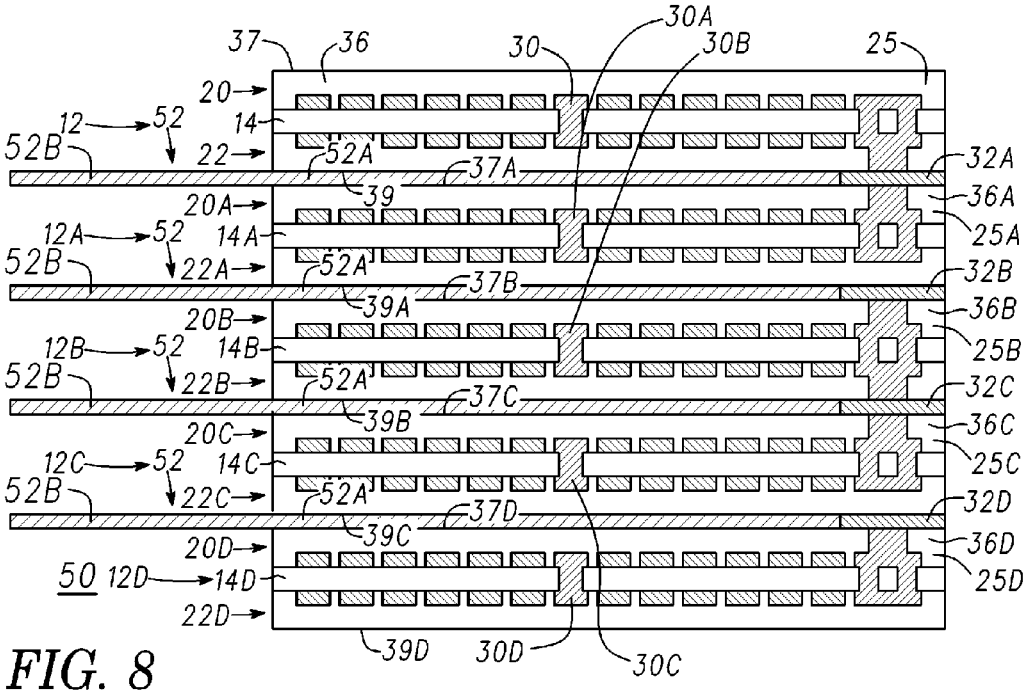
FIG. 8 is a cross-sectional view of stacked inductors in accordance with another embodiment of the present invention.

FIG. 8 is a cross-sectional view of a variable inductance inductor 50 in accordance with another embodiment of the present invention. What is shown in FIG. 8 is a plurality of film coils 12, 12A, 12B, 12C, and 12D stackably connected to each other and vertically spaced apart by magnetic cores 52. More particularly, a magnetic core 52 is sandwiched between film coils 12 and 12A, a magnetic core 52 is sandwiched between film coils 12A and 12B, a magnetic core 52 is sandwiched between film coils 12B and 12C, and a magnetic core 52 is sandwiched between film coils 12D and 12C. Suitable material for magnetic cores 52 include ferrite, cobalt, nickel, permalloy, amorphous steel, or the like. It should be noted that magnetic cores 52 have a portion 52A that is between vertically adjacent film coils and a portion 52B that extends beyond the vertically adjacent film coils. Portions 52 may serve as heat fins of heat sinks to remove heat from variable inductance inductor 50. It should be noted that non-magnetic thin aluminum foils can be used for heat removal and to provide RF shielding.

Figure 9:
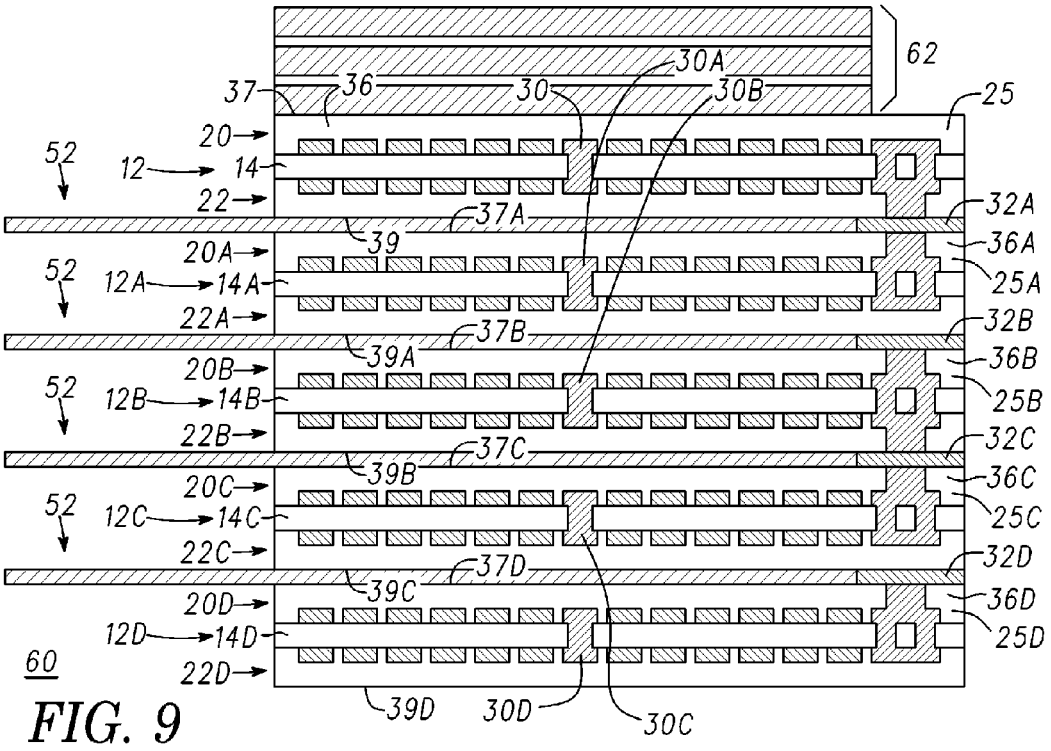
FIG. 9 is a cross-sectional view of a variable inductance inductor in accordance with another embodiment of the present invention.

FIG. 9 is a cross-sectional view of a variable inductance inductor 60 in accordance with another embodiment of the present invention. What is shown in FIG. 9 is a plurality of film coils 12, 12A, 12B, 12C, and 12D stackably connected to each other and vertically spaced apart by magnetic cores 52. More particularly, a magnetic core 52 is sandwiched between film coils 12 and 12A, a magnetic core 52 is sandwiched between film coils 12A and 12B, a magnetic core 52 is sandwiched between film coils 12B and 12C, and a magnetic core 52 is sandwiched between film coils 12D and 12C. Suitable material for magnetic cores 52 include ferrite, cobalt, nickel, permalloy, amorphous steel, or the like. As discussed with reference to FIG. 5, magnetic cores 52 have a portion 52A that is between vertically adjacent film coils and a portion 52B that extends beyond the vertically adjacent film coils. Portions 52B may serve as heat sinks to remove heat from variable inductance inductor 60. It should be further noted that conduction of heat away from variable inductance inductor 60 may be increased by flowing a fluid, e.g., a liquid or gaseous fluid, along portions 52B.

Variable inductance inductor 60 further includes a laminated magnetic core 62 attached to film coil 12. Suitable materials for magnetic core 62 include ferrite, cobalt, nickel, permalloy, amorphous steel, or the like, or the like.

Figure 10:
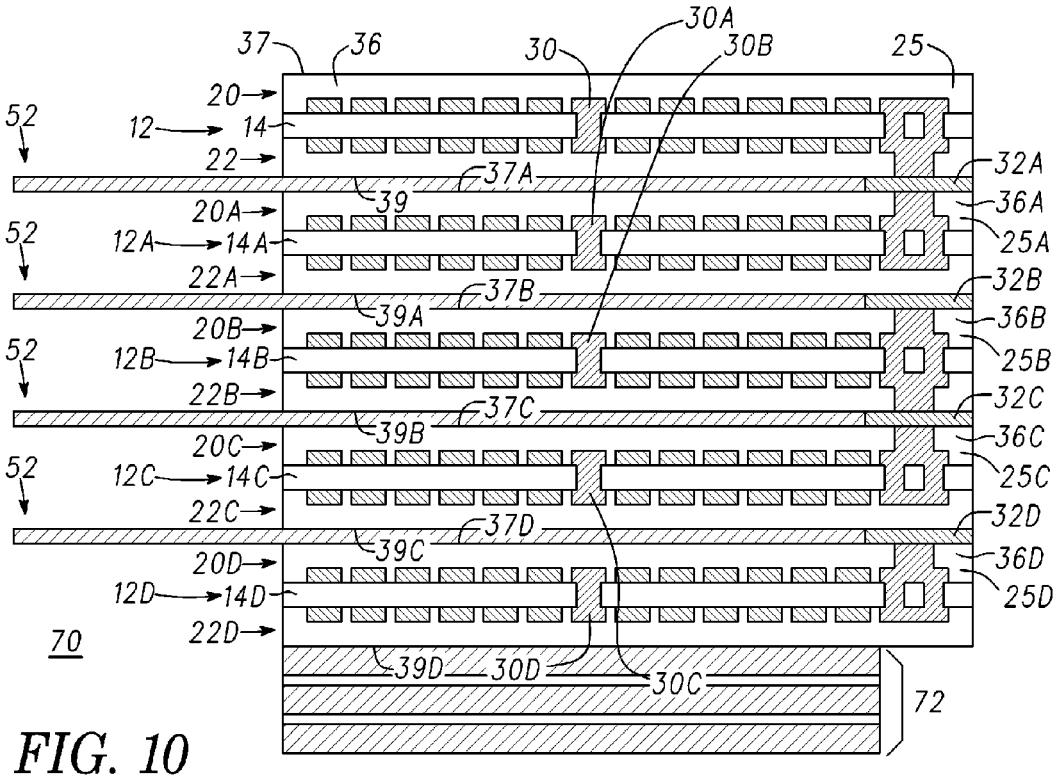
FIG. 10 is a cross-sectional view of a variable inductance inductor in accordance with another embodiment of the present invention.

FIG. 10 is a cross-sectional view of a variable inductance inductor 70 in accordance with another embodiment of the present invention. Variable inductance inductor 70 is similar to variable inductance inductor 60 except that a laminated magnetic core 72 is attached to film coil 12D rather than to film coil 12. Like laminated magnetic core 62, suitable materials for laminated magnetic core 72 include ferrite, cobalt, nickel, permalloy, amorphous steel, or the like.

Figure 11:
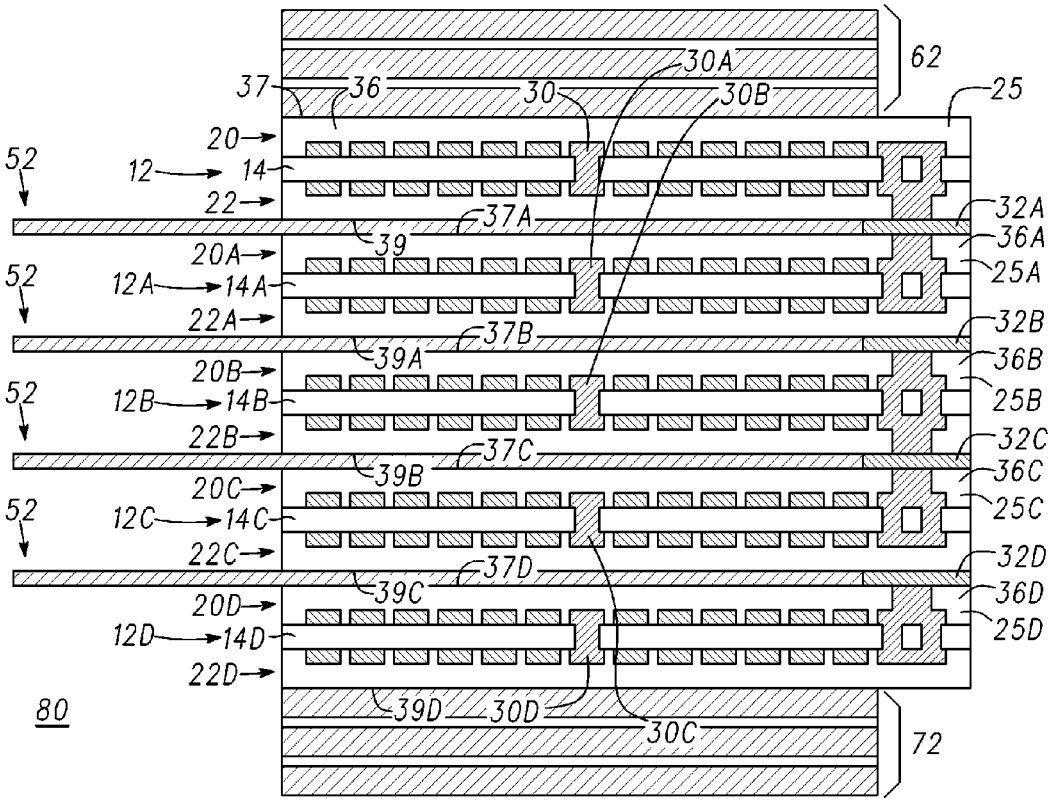
FIG. 11 is a cross-sectional view of a variable inductance inductor in accordance with another embodiment of the present invention.

FIG. 11 is a cross-sectional view of a variable inductance inductor 80 in accordance with another embodiment of the present invention. Variable inductance inductor 80 is similar to variable inductance inductor 60 except that a laminated magnetic core 72 is attached to film coil 12D in addition to laminated magnetic core 62 being attached to film coil 12.

Figure 12:
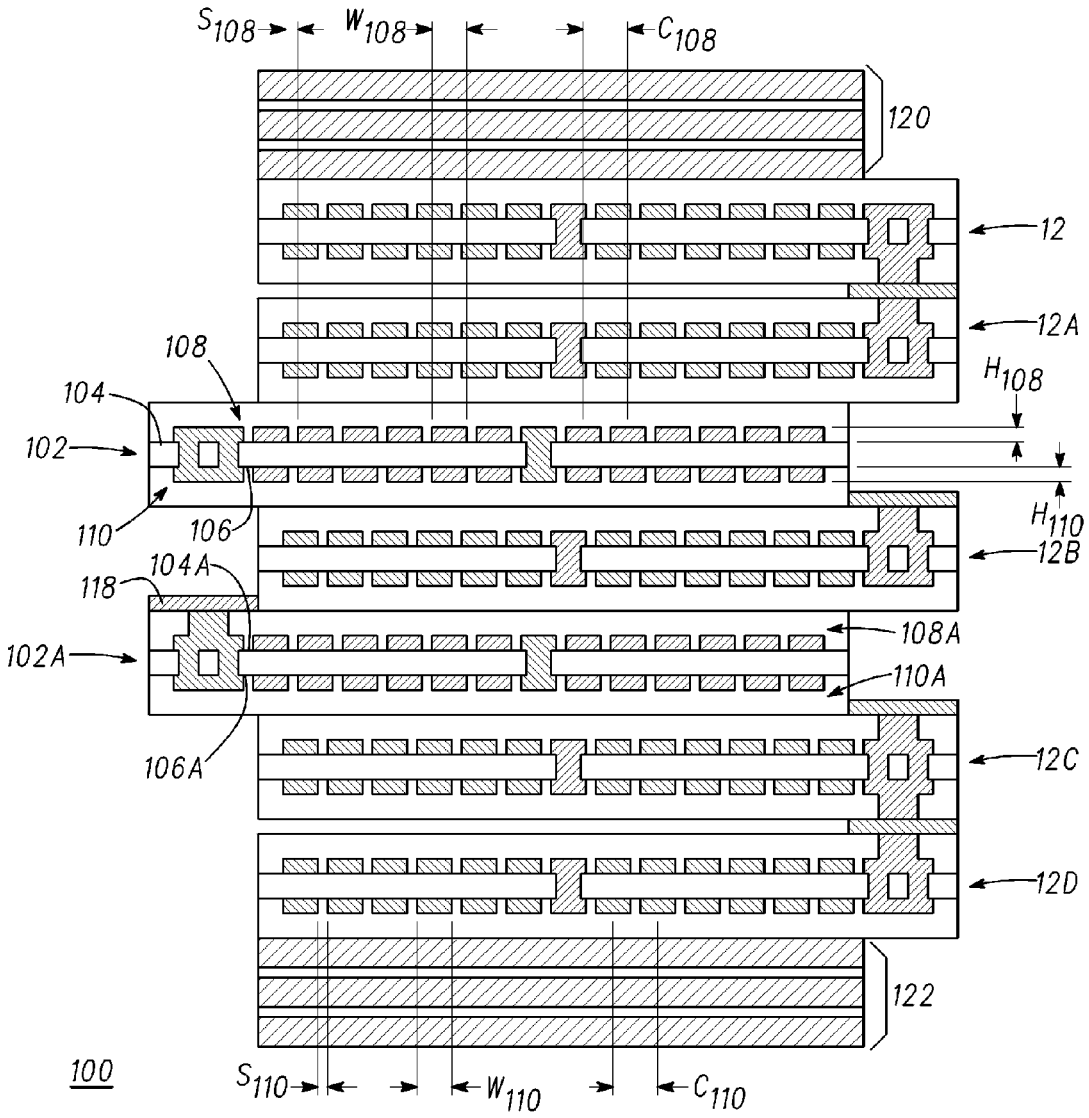
FIG. 12 is a cross-sectional view of a step-down transformer in accordance with another embodiment of the present invention.

FIG. 12 is a cross-sectional view of a step-down transformer 100 in accordance with another embodiment of the present invention. What is shown in FIG. 12 is a plurality of film coils 12 and 12A stackably connected to each other and film coils 12C and 12D stackably connected to each other. Film coil 12A is connected to a film coil 102 and vertically spaced apart from one side of film coil 12B by a film coil 102. Similarly, film coil 12B is connected to a film coil 102A and vertically spaced apart from film coil 12C by film coil 102A. Film coil 102A is attached to a side of film coil 12B that is opposite to the side at which film coil 12A is attached to film coil 102. An inductor 108 is formed on surface 104 and an inductor 110 is formed on surface 106 and an inductor 108A is formed on surface 104A and an inductor 110A is formed on surface 106A. By way of example, inductors 108, 110, 108A, and 110A are spiral shaped thin film inductors comprising copper. The widths $W_{108}$ of an electrically conductive trace of inductor 108 may range from about 50 micrometers to about 2,500 micrometers, the height or thickness $H_{108}$ of the electrically conductive trace of inductor 108 may range from about 1 micrometer to about 100 micrometers, the spacing $S_{108}$ between adjacent electrically conductive traces of inductor 108 may range from about 5 micrometers to about 100 micrometers, and the center-to-center pitch $C_{108}$ between adjacent electrically conductive traces of inductor 108 may range from about 10 micrometers to about 2,000 micrometers. In an example, spacing $S_{20}$ is about 17.5 micrometers and height $H_{108}$ is about 35 micrometers (1 ounce). In another example, spacing $S_{108}$ is about 17.5 micrometers and height $H_{108}$ is about 70 micrometers (2 ounces). The width $W_{110}$ of an electrically conductive trace of inductor 110 may range from about 50 micrometers to about 2,500 micrometers, the height or thickness $H_{110}$ of the electrically conductive trace of inductor 110 may range from about 1 micrometers to about 100 micrometers, the spacing $S_{110}$ between adjacent electrically conductive traces of inductor 110 may range from about 5 micrometers to about 100 micrometers, and the center-to-center pitch $C_{110}$ between adjacent electrically conductive traces of inductor 110 may range from about 10 micrometers to about 2,000 micrometers. In an example, spacing $S_{110}$ is about 17.5 micrometers and height $H_{110}$ is about 35 micrometers (1 ounce). In another example, spacing $S_{110}$ is about 17.5 micrometers and height $H_{110}$ is about 70 micrometers (2 ounces). It should be noted that the height, width, spacing and center-to-center pitch of inductors 108 and 110 may be the same or they may be different. The widths of the inductors of the secondary set of coils have been configured to be greater than those of the primary set of coils so they can carry a higher current. The material and dimensions of inductors 108 and 110 are not limitations. Other suitable materials for inductors 108 and 110 include aluminum, graphite, permalloy, or the like. An end 112 of inductor 108 may be connected to an end 114 of inductor 110 through a filled via 114. Inductor 108A has similar dimensions as inductor 108 and inductor 110A has similar dimensions as inductor 110.

A connector film 118 is formed on film coil 102A. By way of example the material of connector film 118 is the same as the material for inductors 108 and 110. Connector film 118 may be used to electrically connect a film coil to another film coil.

Film coils 102 and 102A are configured such that they are vertically aligned with each other. Likewise, film coils 12, 12A, 12B, 12C, and 12D are vertically aligned with each other, but film coils 102 and 102A are laterally offset from film coils 12, 12A, 12B, 12C, and 12D. Thus, the conductor film 118 is exposed and vertically spaced apart from film coil 102.

Because of the close proximity of film coils 12, 12A, 12B, 12C, 12D, 102, and 102A, there is near-field inductive coupling of the magnetic fields. It should be noted that the inductors or coils of film coils 12, 12A, 12B, 12C, and 12D are configured to serve as a primary set of coils, the inductors or coils of film coils 102 and 102A are configured to serve as a secondary set of coils, the primary coils have more windings than the secondary coils, and that the primary set of coils and the secondary set of coils are configured to form a step-down transformer.

A laminated magnetic core 120 is attached to film coil 12 and a laminated magnetic core 122 is attached to film coil 12D.

Figure 13:
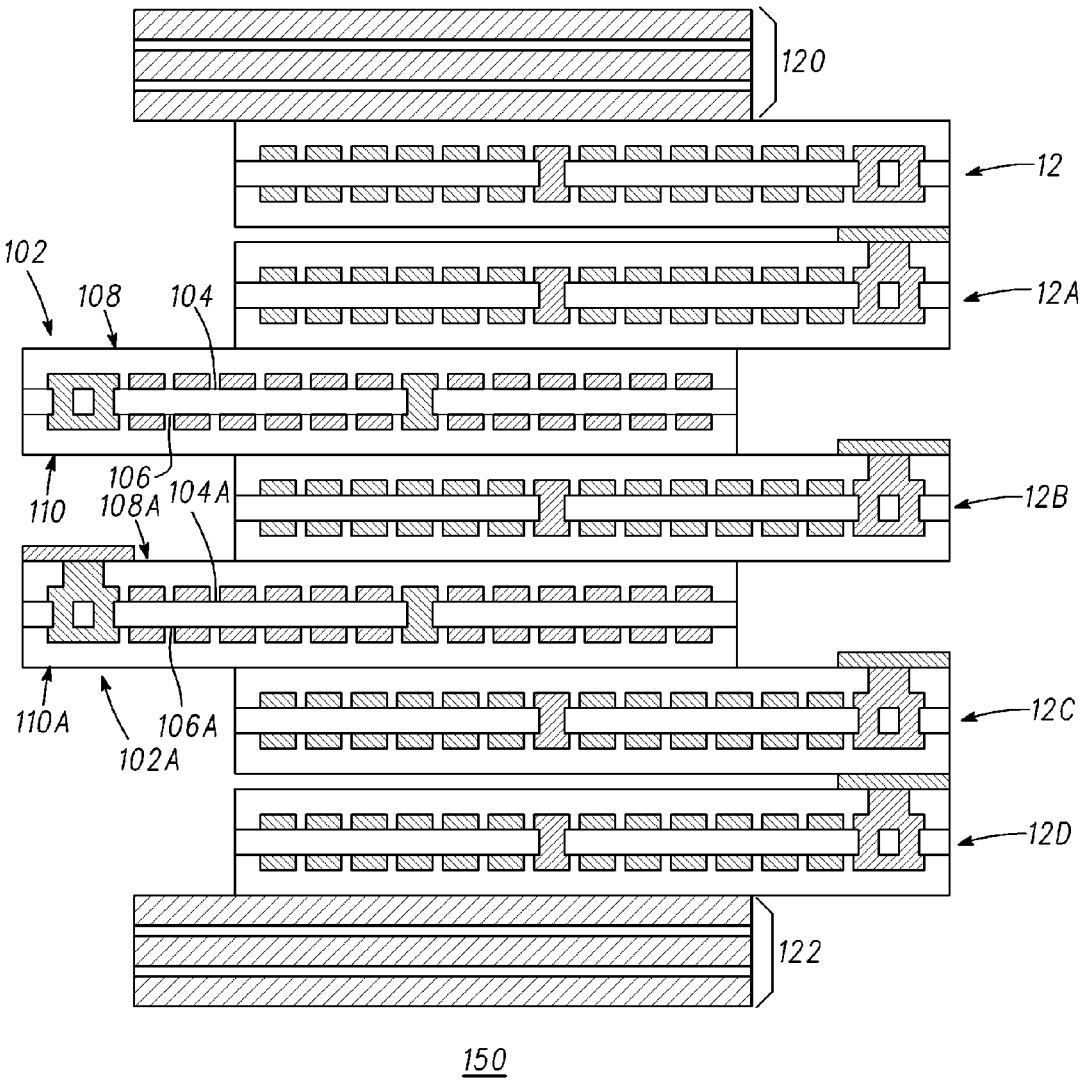
FIG. 13 is a cross-sectional view of a step-down transformer in accordance with another embodiment of the present invention.

It should be noted that the step-down voltage of transformer 100 can be further adjusted by configuring one or both of film coils 102 and 102A and conductor film 118 to have an increased lateral offset as shown in FIG. 13.

Thin magnetic core materials can be inserted between film coils 12 and 12A, between film coils 12C and 12D, between film coils 12A and 102, between film coils 102 and 12B, between film coils 12B and 102A, and between film coils 102A and 12C.

It should be noted that the windings of the film coils are not limited to being uniform or symmetric. In addition, the windings can be circular, irregularly shaped, and the windings can be absent from the centers of the film coils.

Figure 14:
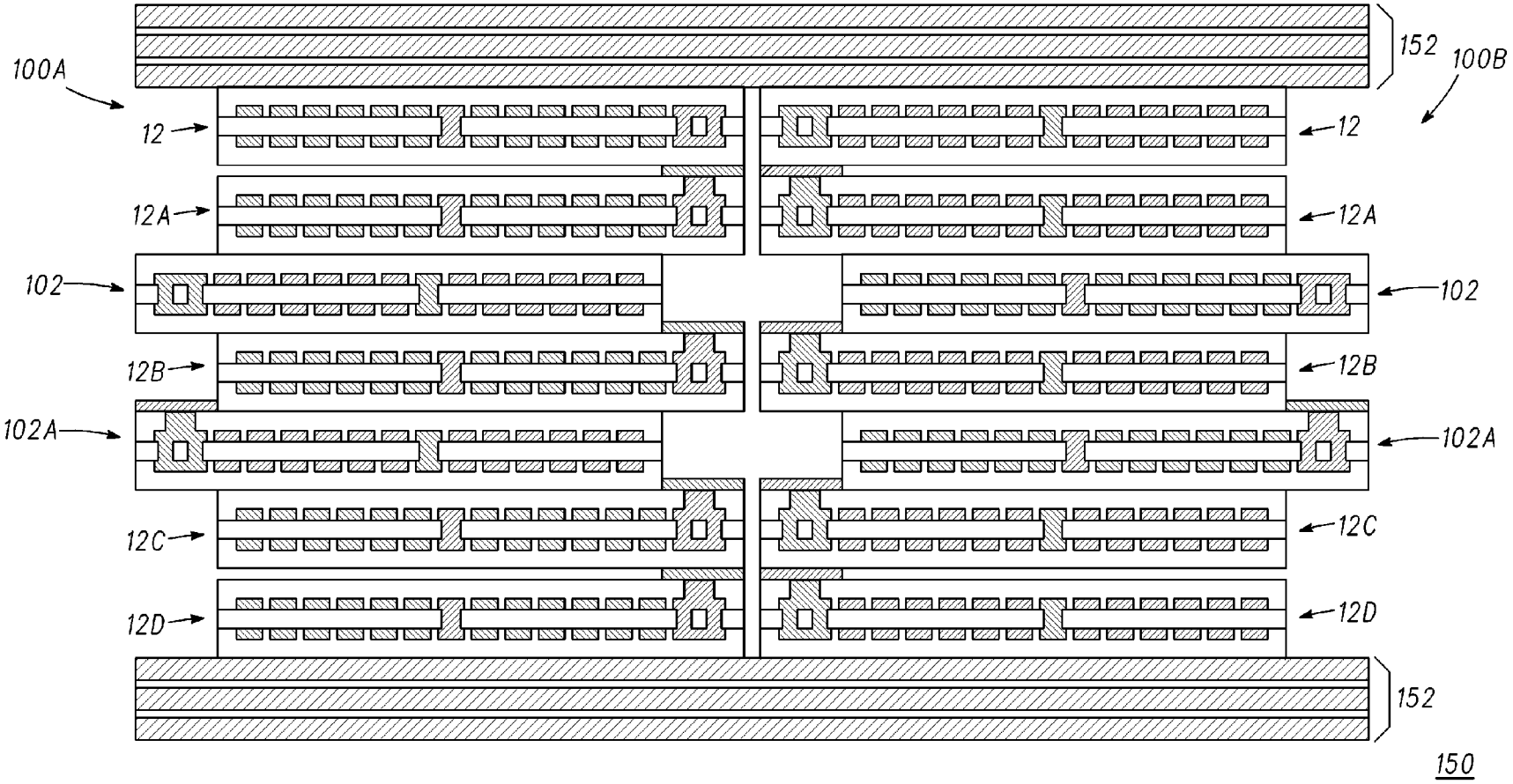
FIG. 14 is a cross-sectional view of a step-down transformer with magnetic cores that have substantially equal shapes in accordance with another embodiment of the present invention.

FIG. 14 is a cross-sectional view of a step-down transformer 150 with magnetic cores that have substantially equal shapes. Step-down transformer 150 comprises two step-down transformers 100, identified as transformers 100A and 100B, and configured such that a second film coil 102 is connected to a second film coil 102A of step-down transformer 100A, connected to a second film coil 102 of step-down transformer 100B, and connected to a second film coil 102A of step-down transformer 100B forming a single secondary winding. The primary and secondary coils are configured and electrically connected so that their magnetic field lines close a loop through two laminated magnetic cores 152 and 154. Magnetic cores 152 and 154 are wider than film coils 102 and 102A of step-down transformer 100A and wider than the film coils 102 and 102A of step-down transformer 100B, which reduces noise caused by electromagnetic interference to affect nearby electronics. Two sets of primary film coil stacks may be connected between film coils 12D of step-down transformer 100A and film coil 12D of step-down transformer 100B and connected to other primary coils and connected to other primary coils 12, 12A, 12B, and 12C.

FIG. 14 shows two adjacent stacks with opposite field lines sharing two separated cores to form a transformer. The transformer thickness may be made thinner by splitting the transformer into two stacks as compared to a single stack. It should be noted that further splitting into three, four, five, or more stacks can be arranged and electrically connected either side by side, in various shapes and sizes or spread far apart with joining an inner layer of film coils to create multiple inductors and transformers as a thin film of integrated electronics. The transformer turns ration can be adjusted upward or downward by configuring the primary film coils to be out of alignment, i.e., sliding them away from alignment.

Figure 15:
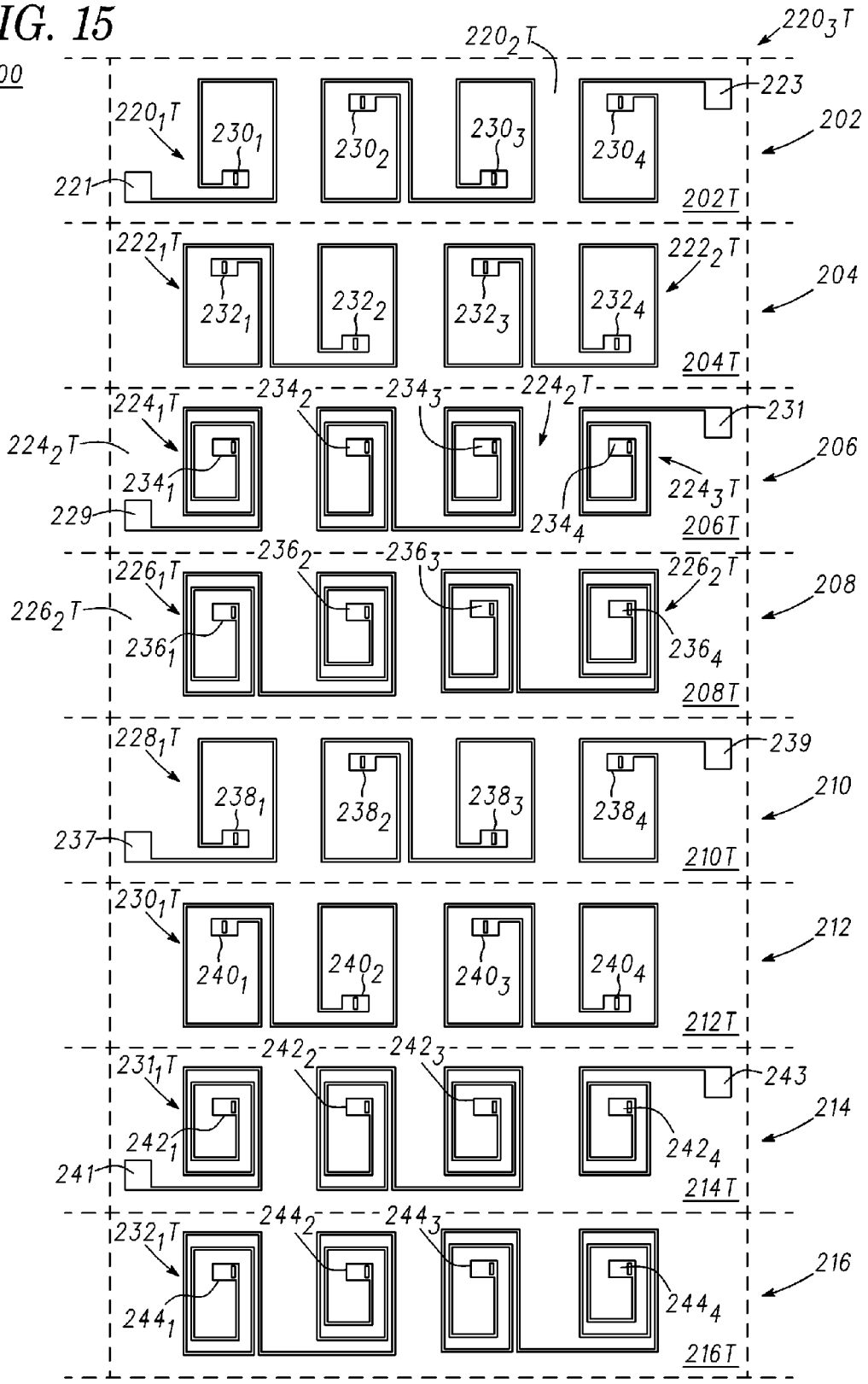
FIG. 15 is a top view of a sheet or panel of a flexible circuit substrate having film coils formed thereon in accordance with another embodiment of the present invention.
Figure 16:
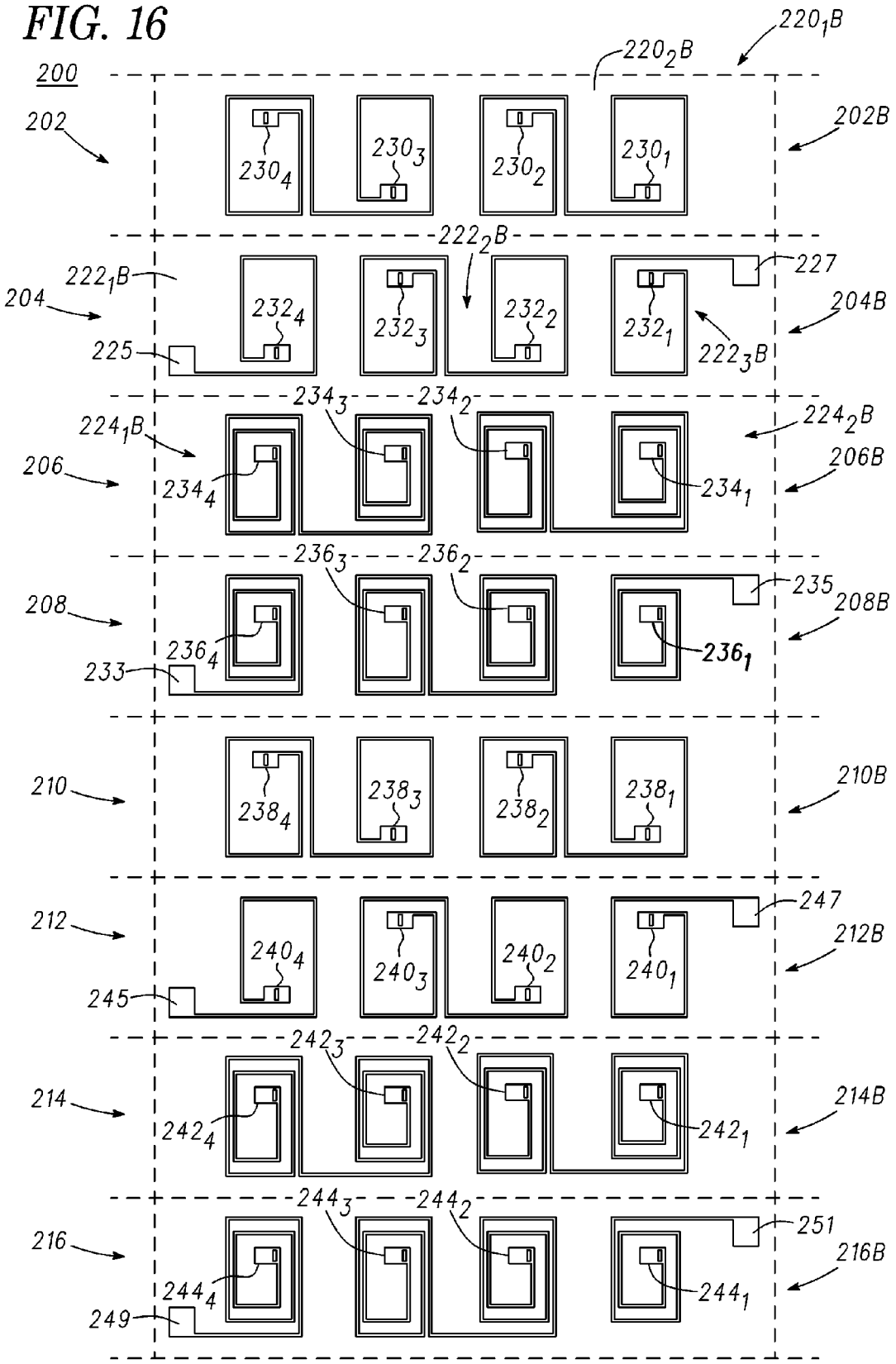
FIG. 16 is a bottom view of the sheet or panel of the flexible circuit substrate of FIG. 15 having film coils formed thereon.

FIG. 15 is a top view of a sheet or panel 200 of a flexible circuit substrate in accordance with another embodiment of the present invention. FIG. 16 is a bottom view of the sheet or panel 200. For the sake of clarity, FIGS. 15 and 16 are described together. Sheet 200 may be divided into a plurality of sections 202, 204, 206, 208, 210, 212, 214, and 216, where the top portions of sections 202, 204, 206, 208, 210, 212, 214, and 216 are identified by reference characters 202T, 204T, 206T, 208T, 210T, 212T, 214T, and 216T in FIG. 15 and the bottom portions of sections 202, 204, 206, 208, 210, 212, 214, and 216 are identified by reference characters 202B, 204B, 206B, 208B, 210B, 212B, 214B, and 216B in FIG. 16. Thus, section 202 is comprised of top portion 202T and bottom portion 202B, section 204 is comprised of top portion 204T and bottom portion 204B, section 206 is comprised of top portion 206T and bottom portion 206B, section 208 is comprised of top portion 208T and bottom portion 208B, section 210 is comprised of top portion 210T and bottom portion 210B, section 212 is comprised of top portion 212T and bottom portion 212B, section 214 is comprised of top portion 214T and bottom portion 214B, and section 216 is comprised of top portion 216T and bottom portion 216B. The number of sections is not a limitation of the present invention. One or more portions of an inductor or coil are formed in each section 202, 204, 206, 208, 210, 212, 214, and 216, where the sections will be singulated from sheet 200 along the slit lines, i.e., the broken lines or dashed lines shown in FIGS. 15 and 16. In accordance with embodiments, thru-vias extend through sections 202, 204, 206, 208, 210, 212, 214, and 216 from portions 202T, 204T, 206T, 208T, 210T, 212T, 214T, and 216T to portions 202B, 204B, 206B, 208B, 210B, 212B, 214B, and 216B, respectively. For example, portion 202T includes coil portions $\mathbf{220}_1$T, $\mathbf{220}_2$T, and $\mathbf{220}_3$T and portion 202B includes coil portions $\mathbf{220}_1$B and $\mathbf{220}_2$B. Thru-vias $\mathbf{230}_1$, $\mathbf{230}_2$, $\mathbf{230}_3$, and $\mathbf{230}_4$ extend through portion 202 for electrically coupling portions of coil portions $\mathbf{220}_1$T, $\mathbf{220}_2$T, and $\mathbf{220}_3$T with coil portions $\mathbf{220}_1$B and $\mathbf{220}_2$B to form an inductor or coil. It should be noted that thru-vias $\mathbf{230}_1$, $\mathbf{230}_2$, $\mathbf{230}_3$, and $\mathbf{230}_4$ extend through section 202 for electrically coupling the coil portions on portion 202T with the coil portions on portion 202B. Contacts 221 and 223 are formed on portion 202T.

Portion 204T includes coil portions $\mathbf{222}_1$T and $\mathbf{222}_2$T and portion 204B includes coil portions $\mathbf{222}_1$B, $\mathbf{222}_2$B, and $\mathbf{222}_3$B. Thru-vias $\mathbf{232}_1$, $\mathbf{232}_2$, $\mathbf{232}_3$, and $\mathbf{232}_4$ extend through portion 204 for electrically coupling portions of coil portions $\mathbf{222}_1$T and $\mathbf{222}_2$T with coil portions $\mathbf{222}_1$B, $\mathbf{222}_2$B, and $222_3$B to form an inductor or coil. It should be noted that thru-vias $232_1$, $232_2$, $232_3$, and $232_4$ extend through section 204 for electrically coupling the coil portions on portion 204T with the coil portions on portion 204B. Contacts 225 and 227 are formed on portion 204B.

Portion 206T includes coil portions $224_1$T, $224_2$T, and $224_3$T and portion 206B includes coil portions $224_1$B and $224_2$B. Thru-vias $234_1$, $234_2$, $234_3$, and $234_4$ extend through portion 206 for electrically coupling coil portions $224_1$T, $224_2$T, and $224_3$T with coil portions $224_1$B and $224_2$B to form an inductor or coil. It should be noted that thru-vias $234_1$, $234_2$, $234_3$, and $234_4$ extend through section 206 for electrically coupling the coil portions on portion 206T with the coil portions on portion 206B. Contacts 229 and 231 are formed on portion 206T.

Portion 208T includes coil portions $226_1$T and $226_2$T and portion 206B includes coil portions $226_1$B, $226_2$B, and $226_3$B. Thru-vias $236_1$, $236_2$, $236_3$, and $236_4$ extend through portion 208 electrically for coupling portions of coil portions $226_1$T and $226_2$T with coil portions $226_1$B, $226_2$B and $226_3$B to form an inductor or coil. It should be noted that thru-vias $236_1$, $236_2$, $236_3$, and $236_4$ extend through section 208 for electrically coupling the coil portions on portion 208T with the coil portions on portion 208B. Contacts 233 and 235 are formed on portion 208B.

Sections 210, 212, 214, and 216 include coil portions, thru vias, and contacts similar to sections 202, 204, 206, and 208, respectively. Thus, thru-vias $238_1$, $238_2$, $238_3$, and $238_4$ extend through section 210 for electrically coupling the coil portions on portion 210T with the coil portions on portion 210B, and contacts 237 and 239 are formed on portion 208T; thru-vias $240_1$, $240_2$, $240_3$, and $240_4$ extend through section 212 for electrically coupling the coil portions on portion 212T with the coil portions on portion 212B, and contacts 245 and 247 are formed on portion 212B; thru-vias $242_1$, $242_2$, $242_3$, and $242_4$ extend through section 214 for electrically coupling the coil portions on portion 214T with the coil portions on portion 214B, and contacts 241 and 243 are formed on portion 214T; and thru-vias $244_1$, $244_2$, $244_3$, and $244_4$ extend through section 216 for electrically coupling the coil portions on portion 216T with the coil portions on portion 216B, and contacts 249 and 251 are formed on portion 216B.

Thus, a method for forming an inductor includes providing a flexible electrically insulating substrate having a first major surface and a second major surface. A first electrically conductive trace having first and second terminals is formed on a first portion of the first major surface wherein the first electrically conductive trace has a first annular-shaped portion between the first terminal and the second terminal. A first thru-via extends from the second terminal of the first electrically conductive trace through the flexible electrically insulating substrate. A second electrically conductive trace having first and second terminals is formed on a first portion of the second major surface. The second electrically conductive trace has a second annular-shaped portion between the first terminal and the second terminal of the second electrically conductive trace. The first thru-via extends to the first terminal of the second electrically conductive trace, and a second thru-via extends from the second terminal of the second electrically conductive trace through the flexible electrically insulating substrate.

The flexible electrically insulating substrate may have a thickness of less than 150 micrometers.

In accordance with another embodiment, a third electrically conductive trace is formed on a second portion of the first major surface, wherein the third electrically conductive trace has a first terminal, a second terminal, a first annular-shaped portion and a second annular shaped portion between the first terminal and the second terminal of the third electrically conductive trace. The second thru-via extends to the first terminal of the third electrically conductive trace, and a third thru-via extends from the second terminal of the third electrically conductive trace through the flexible electrically insulating substrate.

In accordance with another embodiment, a fourth electrically conductive trace is formed on a second portion of the second major surface. The fourth electrically conductive trace has a first terminal, a second terminal, a first annular-shaped portion, and a second annular-shaped portion wherein the annular shaped portions are between the first terminal and the second terminal of the second electrically conductive trace. The third thru-via extends to the first terminal of the fourth electrically conductive trace and a fourth thru-via extends from the second terminal of the fourth electrically conductive trace through the flexible electrically insulating substrate.

In accordance with another embodiment, a fifth electrically conductive trace is formed on a third portion of the first major surface, wherein the fifth electrically conductive trace has a first terminal, a second terminal, and a first annular-shaped portion between the first terminal and the second terminal of the fifth electrically conductive trace. The fourth thru-via extends from the second terminal of the fifth electrically conductive trace through the flexible electrically insulating substrate. It should be noted that the second portion of the first major surface is between the first portion of the first major surface and the third portion of the first major surface.

In accordance with another embodiment, the flexible electrically insulating substrate is folded such that the first annular portion of the third electrically conductive trace faces the second annular portion of the third electrically conductive trace and the first annular portion of the second electrically conductive trace faces the second annular portion of the second electrically conductive trace.

Figure 17:
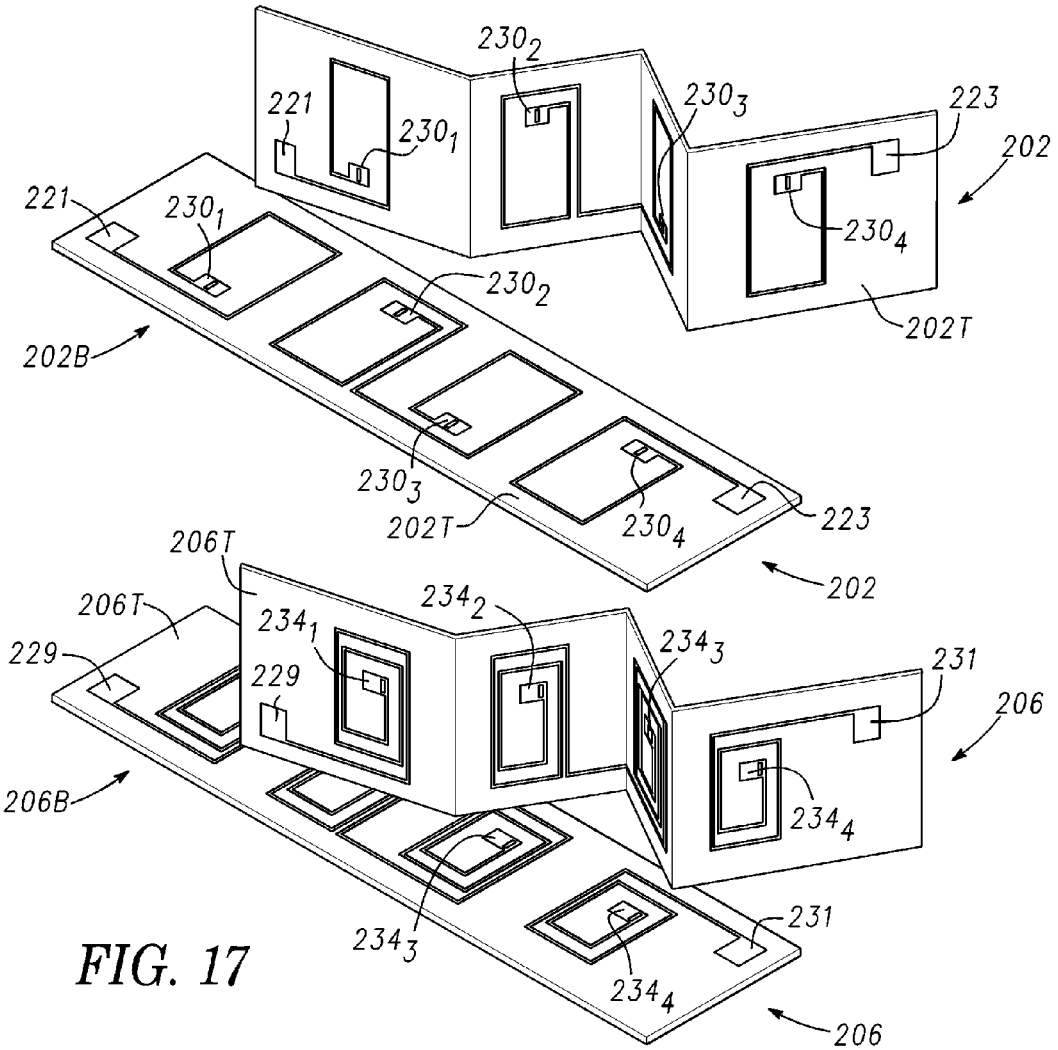
FIG. 17 is a view of portions of sections of the flexible circuit substrate after being cut into strips in accordance with an embodiment of the present invention.

FIG. 17 is a top view of portion 202T of section 202 and an isometric view of section 202 that includes portions 202T and 202B after singulation. The isometric view of section 202 shows the folding and alignment of layers of coils of section 202. Section 202 is folded to align the layers of coils formed on portions 202T and 202B closely together. In accordance with an embodiment, section 202 is folded into a W-shape such that the coil portions having thru-vias $230_2$ and $230_3$ on the same side of portion 202T face each other; the coil portions having thru-vias $230_1$ and $230_2$ on the same side of portion 202B face each other; and the coil portions having thru-vias $230_3$ and $230_4$ on the same side of portion 202B face each other. In addition, FIG. 17 shows a top view of portion 206T of section 206 and an isometric view of section 206 that includes portions 206T and 206B after singulation. The isometric view of section 206 shows the folding and alignment of layers of coils of section 206. Section 206 is folded to align the layers of coils formed on portions 206T and 206B closely together. In accordance with an embodiment, section 206 is folded into a W-shape such that the coil portions having thru-vias $234_2$ and $234_3$ on the same side of portion 206T face each other; the coil portions having thru-vias $234_1$ and $234_2$ on the same side of portion 206B face each other; and the coil portions having thru-vias $234_3$ and $234_4$ on the same side of portion 206B face each other. Thus sections 202-216 are made from a flexible, foldable substrate material 200.

Figure 18:
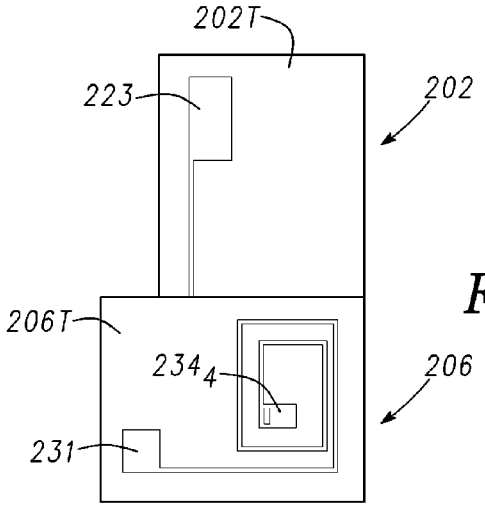
FIG. 18 is a top view of sections of the flexible circuit substrate after being cut into strips and folded in accordance with an embodiment of the present invention.

FIG. 18 is a top view of, for example, sections 202 and 206 after they have been positioned together after being folded into the W-shapes. W-shaped section 202 is interdigitated with W-shaped section 206 to form an inductor, i.e., portions of section 202 have been inserted between portions of section 206. Sections 202 and 206 may be pressed together to increase inductive coupling between the coils.

Figure 19:
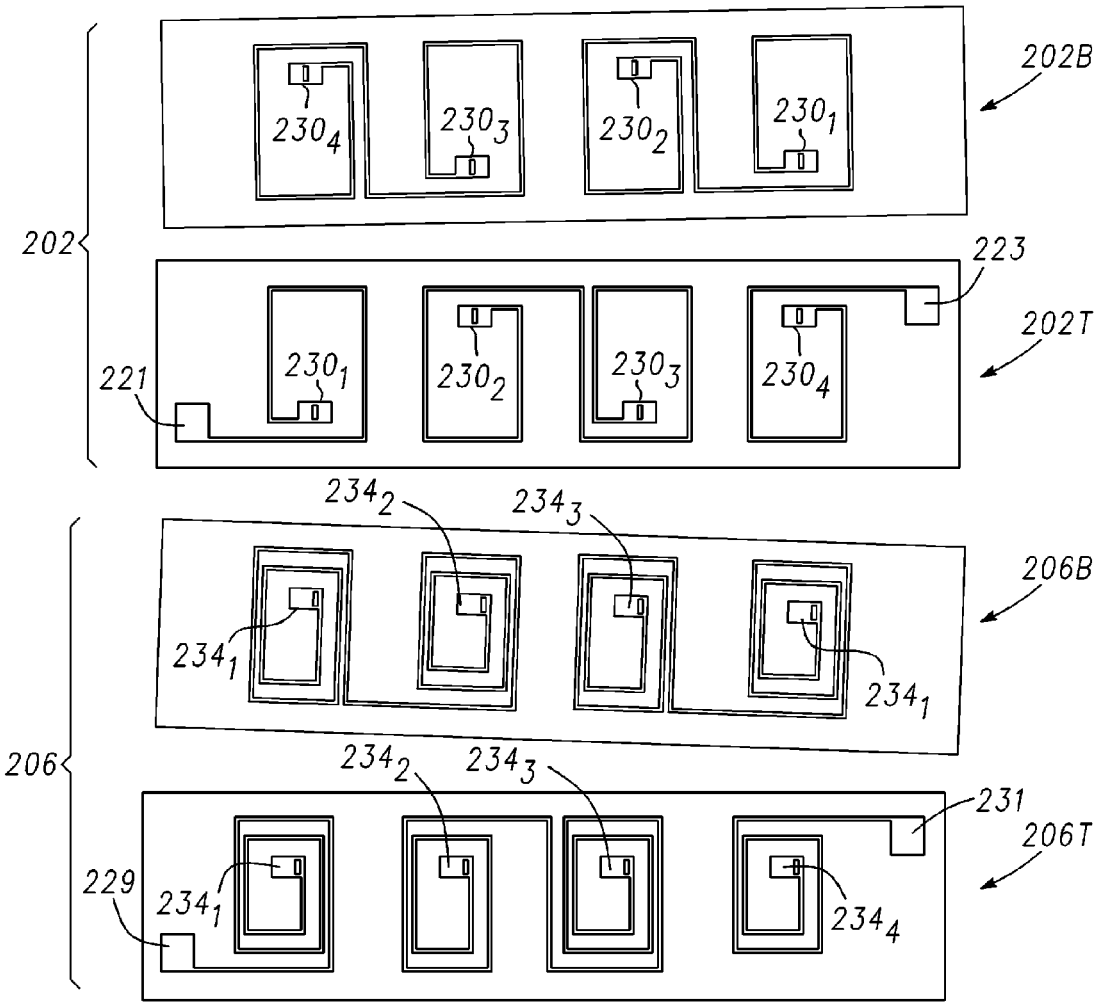
FIG. 19 illustrates views of a plurality of sections of the sheet or panel of the flexible circuit substrate in accordance with an embodiment of the present invention.

FIG. 19 is a top view and a bottom view of sections 202 and 206 after singulation in accordance with an embodiment of the present invention. What is shown in FIG. 18 are portions 202T and 202B of section 202 and portions 206T and 206B after singulation.

Although embodiments have been shown illustrating sections 202 and 206, it should be understood this is not a limitation of the present invention. Other sections can be singulated, folded, and woven together. Weaving the sections together may be referred to as interdigitating the sections.

Thus, in accordance with an embodiment of the present invention, a circuit element, comprising a first flexible substrate having first and second surfaces, wherein a first portion of a first inductor has first and second ends and is formed on the first surface and a second portion of the first inductor is formed on the second surface, wherein the second portion of the first inductor has first and second ends. A first thru-via extends from the first surface to the second surface. It should be noted that the flexible substrate is capable of being folded, i.e. it is foldable.

In accordance with an embodiment, the first portion of the first inductor comprises a first electrically conductive trace having a first end and a second end and the second portion of the first inductor comprises a second electrically conductive trace having a first end and a second end. The first end of the first electrically conductive trace serves as a first terminal of the first inductor and the second end of the first electrically conductive trace is electrically coupled to the first end of the second electrically conductive trace.

In accordance with another embodiment, the circuit element further comprises a third portion of the first inductor formed on the first surface, wherein the third portion of the first inductor has a first end and a second end and a fourth portion of the first inductor formed on the second surface, wherein the fourth portion of the first inductor has a first end and a second end.

In accordance with another embodiment, the third portion of the first inductor comprises a third electrically conductive trace having a first end and a second end, and the fourth portion of the first inductor comprises a fourth electrically conductive trace having a first end and a second end, wherein the first end of the third electrically conductive trace is electrically coupled to the second end of the second electrically conductive trace and the second end of the third electrically conductive trace is coupled to the first end of the fourth electrically conductive trace.

In accordance with another embodiment, the circuit element further comprises a fifth portion of the first inductor formed on the first surface, the fifth portion of the first inductor having a first end and a second end; and a sixth portion of the first inductor formed on the second surface, the sixth portion of the first inductor having a first end and a second end, wherein the fifth portion of the first inductor comprises a fifth electrically conductive trace having a first end and a second end, and the sixth portion of the first inductor comprises a sixth electrically conductive trace having a first end and a second end, wherein the first end of the fifth electrically conductive trace is electrically coupled to the second end of the fourth electrically conductive trace and the second end of the fifth electrically conductive trace is coupled to the first end of the sixth electrically conductive trace.

In accordance with another embodiment, the circuit element further comprises a seventh portion of the first inductor formed on the first surface, the seventh portion of the first inductor having a first end and a second end; and an eighth portion of the first inductor formed on the second surface, the eighth portion of the first inductor having a first end and a second end, wherein the seventh portion of the first inductor comprises a seventh electrically conductive trace having a first end and a second end, and the eighth portion of the first inductor comprises an eighth electrically conductive trace having a first end and a second end, wherein the first end of the seventh electrically conductive trace is electrically coupled to the second end of the eighth electrically conductive trace and the second end of the seventh electrically conductive trace is electrically coupled to the first end of the eighth electrically conductive trace.

In accordance with another embodiment, the circuit element further includes a first magnetic core adjacent a first portion of the first surface.

In accordance with another embodiment, the circuit element further includes a first magnetic core adjacent a first portion of the first surface and a second magnetic core adjacent the second portion of the first surface.

In accordance with another embodiment, the first flexible substrate is configured as a folded structure in the shape of a W, wherein a first portion of the first surface faces a second portion of the first surface.

In accordance with another embodiment, the circuit element comprises a magnetic core between the first portion of the first surface and the second portion of the second surface of the first flexible substrate.

In accordance with another embodiment, the circuit element includes a second flexible substrate having first and second surfaces, wherein a first portion of a second inductor has first and second ends and is formed on the first surface of the second flexible substrate, and wherein a second portion of the second inductor is formed on the second surface of the second flexible substrate, wherein the second portion of the second inductor has a first end and a second end. A first thru-via extends from the first surface of the second flexible substrate to the second surface second flexible substrate, wherein the second flexible substrate is foldable.

In accordance with another embodiment, the second flexible substrate is configured as a folded structure in the shape of a W, wherein a first portion of the first surface of the second flexible substrate faces a second portion of the first surface of the second flexible substrate.

In accordance with another embodiment of the present invention, a first flexible electrically insulating substrate having a first major surface and a second major surface is provided, wherein the first flexible electrically insulating substrate is foldable. A first electrical conductor is formed on a first portion of the first major surface. The first electrical conductor has a first terminal, a second terminal, and a first annular-shaped portion between the first terminal and the second terminal. A first thru-via extends from the second terminal of the first electrically conductive trace through the first flexible electrically insulating substrate. A second electrical conductor is formed on a second portion of the first major surface, wherein the second electrical conductor has a first terminal, a second terminal, and a pair of annular-shaped portions between the first terminal and the second terminal of the second electrical conductor. A second thru-via extends from the first terminal of the second electrical conductor through the first flexible electrically insulating substrate and a third thru-via extends from the second terminal of the second electrical conductor through the first flexible electrically insulating substrate. A third electrical conductor is formed on a third portion of the first major surface, wherein the third electrical conductor has a first terminal, a second terminal, and a first annular-shaped portion between the first terminal and the second terminal of the third electrical conductor. The fourth thru-via extends from the first terminal of the first third electrical conductor through the first flexible electrically insulating substrate. A fourth electrical conductor having a first terminal and a second terminal is formed on a first portion of the second major surface. The fourth electrical conductor has a first terminal, a second terminal, and first and second annular-shaped portions between the first terminal and the second terminal of the fourth electrical conductor. A first thru-via extends from the first terminal of the fourth electrical conductor through the first flexible electrically insulating substrate and the third thru-via extends from the second terminal of the fourth electrical conductor through the first flexible electrically insulating substrate. A fifth electrical conductor having first and second terminals is formed on a second portion of the second major surface, wherein the fifth electrical conductor has a first terminal, a second terminal, and first and second annular-shaped portions between the first terminal and the second terminal of the fifth electrical conductor. The third thru-via extends from the first terminal of the fifth electrical conductor through the flexible electrically insulating substrate and a fourth thru-via extends from the second terminal of the fifth electrical conductor through the first flexible electrically insulating substrate.

In accordance with another embodiment, a second flexible electrically insulating substrate having a first major surface and a second major surface is provided. Like the first flexible substrate, the second flexible substrate is capable of being folded. A sixth electrical conductor having first and second terminals is formed on a first portion of the first major surface of the second flexible electrically insulating substrate. The sixth electrical conductor includes a first annular-shaped portion between the first terminal and the second terminal and a fifth thru-via that extends from the second terminal of the sixth electrically conductive trace through the second flexible electrically insulating substrate. A seventh electrical conductor having first and second terminals is formed on a second portion of the first major surface of the second flexible electrically insulating substrate. The seventh electrical conductor includes first and second annular-shaped portions between the first terminal and the second terminal of the seventh electrical conductor. The fifth thru-via extends from the first terminal of the seventh electrical conductor through the flexible electrically insulating substrate and a sixth thru-via extends from the second terminal of the seventh electrical conductor through the second flexible electrically insulating substrate. An eighth electrical conductor having first and second terminals is formed on a third portion of the first major surface of the second flexible electrically insulating substrate. In addition, the eighth electrical conductor has an annular-shaped portion between the first terminal and the second terminal of the third electrical conductor. The sixth thru-via extends from the first terminal of the eighth electrical conductor through the second flexible electrically insulating substrate. A ninth electrical conductor having first and second terminals is formed on a first portion of the second major surface of the second flexible electrically insulating substrate. In addition, the ninth electrical conductor has first and second annular-shaped portions between the first terminal and the second terminal of the ninth electrical conductor. The sixth thru-via extends from the first terminal of the ninth electrical conductor through the flexible electrically insulating substrate and a seventh thru-via extends from the second terminal of the ninth electrical conductor through the flexible electrically insulating substrate. A tenth electrical conductor having first and second terminals is formed on a second portion of the second major surface of the second flexible electrically insulating substrate. In addition, the tenth electrical conductor has first and second annular-shaped portions between the first terminal and the second terminal of the fifth electrical conductor. The seventh thru-via extends from the first terminal of the tenth electrical conductor through the flexible electrically insulating substrate and an eighth thru-via extends from the second terminal of the tenth electrical conductor through the second flexible electrically insulating substrate. The first flexible electrically insulating substrate and the second flexible electrically insulating substrate are folded to have W-shapes. The first flexible electrically insulating substrate is inserted between portions of the second flexible electrically insulating substrate.

Those skilled in art realize that materials, processes and equipment continue to improve with time. Electronics shrink. Film coil allows fantastic shrinkage and improvement for inductors and transformers with availability of advance conductors, dielectrics, deposition and etch equipment. Coupling coefficient improves as the distance separating film coils is decreased. To shrink these devices, thinner films are desirable. For example, although copper is excellent conductor but a lighter weight, stronger, thinner conductor for ultra-high frequency is planar graphite. A thinner, lighter weight, thermally conducting, superior coverlay is diamond film. FPC film coil technology accelerates ever thinner, bendable, fine pitched coils to be efficiently produced at lower cost. Inductors and transformers in accordance with the embodiments operate at higher temperatures, greater power density, higher flux density and GHz switching frequencies. The stacking of film coils remains same but the film materials will change to achieve higher performance.

Dielectric film is not limited to polyimide, BZT, Teflon or diamond and conductor is not limited to copper and graphite. At less than 100 kHz, amorphous steel is a suitable material. Ferrite particles bonded into organic film may be used. Higher performance than ferrite/epoxy composite, 100% ferrite can be sandwiched between film cores. Thick ferrite cores can be attached at both ends of inductor coils. Above GHz frequencies, Teflon film or thin ceramic substrates may be used in place of polyimide.

In the embodiment of FIG. 14 the film coils are made of polyimide film with double sided copper. A film coil transformer has an added advantage because different materials can be employed within one transformer. For example if a 100:1 turns ratio, step down, isolation transformer were desirable to sense and feed-back high voltage and current of an electric vehicle motor back to the motor drive control circuits, then primary coils can be made of thin dielectric with ultra-fine pitch, graphite windings and thin deposited diamond as coverlays. In same manner, the primary coils can also be produced having high number of turns or windings per unit area. Dielectric films such as, for example, glass, oxide insulated silicon, Teflon or liquid crystal polymer can be used instead of polyimide. Instead of thick electroplated Cu, 500 nm thin aluminum can be vacuum sputtered with narrow sub-micron dry etch technology from silicon wafer processing to produce dense windings n. Other suitable conductors include 400 nm Cu, sputtered NiV, thin electroplated CrCu, NiCr. Instead of diamond or polyimide coverlays, plasma oxide/nitride can be deposited over thin conductors for insulation. The coverlays can be combination of 2 dielectric layers on top of thin aluminum windings. Plasma oxide/nitride, 600 nm PON, may be deposited first and then 3 microns polyimide may be coated over PON as final passivation. Film coils provide the ability to mix, combine different manufacturing technologies and higher performance materials in order to produce integrated, variable transformers not practical in another way.

Composite and different core materials can be combined. For example the heat sink fin region can be non-magnetic material such as aluminum to thermally conduct heat away. For MHz operation, inner magnetic core can be thin ferrite and the outer heat fins can be thin aluminum or other thermally conducting material shaped as ring with an inner cavity to contain the inner ferrite core.

Ni, Co, Mo and Fe are magnetic metals and their alloys are electrical conductors. These magnetic metals are not great electrical or thermal conductors as copper or aluminum. However, for a 100:1 turns-ratio, feed-back, signal transformer, a low resistance primary winding may not be important. More resistive thin, Ni, Co, Fe film conductors can serve both as winding metal as well as magnetic core to achieve high flux density with thin film coils.

Above GHz frequencies, magnetic cores may no longer be needed. Organic films that absorb moisture become lossy, other dielectric materials such as Teflon and ceramics can be used. Thin diamond film as dielectric that insulates and transfers heat out from between film coils may be used.

Wire wound transformers and inductors are bulky and heavy. Film coils are produced in layers and then stacked. Embodiments of the present invention provide design, adjustability, system integration and the production of lighter weight, lower cost, power electronics.

By now it should be appreciated that inductors, transformers, and methods for making the inductors and transformers have been provided. In accordance with embodiments, the inductors are thin, bendable, and flexible and can be configured as transformers. Transformers in accordance with embodiments can be integrated with other devices, e.g., transistors, diodes, power semiconductor devices, resistors, capacitors, or the like, inside a single film to provide light weight systems. Inductors, transformers, heat sinks, power semiconductor devices, and other circuit elements can be integrated and produced in a roll-to-roll format. Magnetic cores can be sandwiched between film coils or attached to one or both ends of a stack of film coils. The inductance can be varied or adjusted by sliding a film coil over a vertically adjacent film coil so that the film coils are aligned or so that there is an offset in the alignment. The stacked film coils can be densely packed to optimize the coupling of magnetic fields produced by the film coils. In an application with an electric vehicle, the electric vehicle battery charging stations can continuously fine tune the inductance to match the resonance frequency to maximize power transfer from a transmitter to receiving coils.

In accordance with embodiments of the present invention, integrated film electronics is provided that improves the high flux density, wireless energy transfer, conducted and radiated noise isolation, wasted heat dissipation, eddy currents, radio frequency (RF) losses, total system size, thickness, weight, RF shielding and costs. In addition, film inductors and film transformers in accordance with embodiments of the present invention can be adjusted and varied to optimize analog-mixed signals and inductor-capacitor (LC) oscillating circuits. The number of turns and the turns ratio can be defined during stacking of film transformers and inductors.

In addition, multiple layers of coils can be stacked to achieve high inductance through multi-layers coupling; inductance value can be adjusted to form a variable transformer by moving one or more layers relative to other layers of coils. The thin film inductors can be formed by sandwiching or inserting many magnetic cores between layers of coils. However, the presence of magnetic core increases total thickness plus adds to cost. Alternatively, in accordance with embodiments, magnetic material may be absent from between the stacked layers of film coils in the thin film inductors and thin film transformers.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A method for manufacturing an inductor, comprising:

providing a flexible electrically insulating substrate having a first major surface and a second major surface;

forming a first electrically conductive trace on a first portion of the first major surface, the first electrically conductive trace having a first terminal, a second terminal, and a first annular-shaped portion between the first terminal and the second terminal, wherein a first thru-via extends from the second terminal of the first electrically conductive trace through the flexible electrically insulating substrate;

forming a second electrically conductive trace on a first portion of the second major surface, the second electrically conductive trace having a first terminal, a second terminal, a first annular-shaped portion between the first terminal and the second terminal of the second electrically conductive trace, and a second annular-shaped portion between the first terminal and the second terminal of the second electrically conductive trace, wherein the first thru-via extends to the first terminal of the second electrically conductive trace, and a second thru-via extends from the second terminal of the second electrically conductive trace through the flexible electrically insulating substrate; and folding the flexible electrically insulating substrate such that the first annular portion of the second electrically conductive trace is adjacent the second major surface of the flexible electrically insulating substrate.

2. The method of claim 1, wherein providing the flexible electrically insulating substrate includes providing the flexible electrically insulating substrate having a thickness of less than 150 micrometers.

3. The method of claim 2, further including forming a third electrically conductive trace on a second portion of the first major surface, the third electrically conductive trace having a first terminal, a second terminal, a first annular-shaped portion between the first terminal and the second terminal of the third electrically conductive trace, and a second annular-shaped portion between the first terminal and the second terminal of the third electrically conductive trace, wherein the second thru-via extends to the first terminal of the third electrically conductive trace, and a second thru-via extends from the second terminal of the third electrically conductive trace through the flexible electrically insulating substrate.

4. The method of claim 3, further including forming a fourth electrically conductive trace on a second portion of the second major surface, the fourth electrically conductive trace having a first terminal, a second terminal, a first annular-shaped portion between the first terminal and the second terminal of the second electrically conductive trace, and a second annular-shaped portion between the first terminal and the second terminal of the fourth electrically conductive trace, wherein the third thru-via extends to the first terminal of the fourth electrically conductive trace, and a fourth thru-via extends from the second terminal of the fourth electrically conductive trace through the flexible electrically insulating substrate.

5. The method of claim 4, further including forming a fifth electrically conductive trace on a third portion of the first major surface, the fifth electrically conductive trace having a first terminal, a second terminal, and a first annular-shaped portion between the first terminal and the second terminal of the fifth electrically conductive trace, wherein the fourth thru-via extends from the second terminal of the fifth electrically conductive trace through the flexible electrically insulating substrate, and wherein the second portion of the first major surface is between the first portion of the first major surface and the third portion of the first major surface.

6. The method of claim 5, further including folding the flexible electrically insulating substrate such that the first annular portion of the third electrically conductive trace faces the second annular portion of the third electrically conductive trace and the first annular portion of the second electrically conductive trace faces the second annular portion of the second electrically conductive trace.

7. A method for manufacturing an inductor, comprising:

providing a first flexible electrically insulating substrate having a first major surface and a second major surface;

providing a second flexible electrically insulating substrate having a first major surface and a second major surface;

forming a first electrical conductor on a first portion of the first maj or surface, the first electrical conductor having a first terminal, a second terminal, and a first annular-shaped portion between the first terminal and the second terminal, wherein a first thru-via extends from the second terminal of the first electrically conductive trace through the first flexible electrically insulating substrate;

forming a second electrical conductor on a second portion of the first major surface, the second electrical conductor having a first terminal, a second terminal, a first annular-shaped portion between the first terminal and the second terminal of the second electrical conductor, and a second annular-shaped portion between the first terminal and the second terminal of the second electrical conductor, wherein a second thru-via extends from the first terminal of the second electrical conductor through the first flexible electrically insulating substrate and a third thru-via extends from the second terminal of the second electrical conductor through the first flexible electrically insulating substrate;

forming a third electrical conductor on a third portion of the first major surface, the third electrical conductor having a first terminal, a second terminal, and a first annular-shaped portion between the first terminal and the second terminal of the third electrical conductor, wherein a fourth thru-via extends from the first terminal of the third electrical conductor through the first flexible electrically insulating substrate;

forming a fourth electrical conductor on a first portion of the second major surface, the fourth electrical conductor having a first terminal, a second terminal, a first annular-shaped portion between the first terminal and the second terminal of the fourth electrical conductor, and a second annular-shaped portion between the first terminal and the second terminal of the fourth electrical conductor, wherein the first thru-via extends from the first terminal of the fourth electrical conductor through the first flexible electrically insulating substrate and the third thru-via extends from the second terminal of the fourth electrical conductor through the first flexible electrically insulating substrate;

forming a fifth electrical conductor on a second portion of the second major surface, the fifth electrical conductor having a first terminal, a second terminal, a first annular-shaped portion between the first terminal and the second terminal of the fifth electrical conductor, and a second annular-shaped portion between the first terminal and the second terminal of the fifth electrical conductor, wherein the third thru-via extends from the first terminal of the fifth electrical conductor through the flexible electrically insulating substrate and a fourth thru-via extends from the second terminal of the fifth electrical conductor through the first flexible electrically insulating substrate; and folding the first flexible electrically insulating substrate to have a W-shape;

folding the second flexible electrically insulating substrate to have a W-shape; and inserting portions of the first flexible electrically insulating substrate between portions of the second flexible electrically insulating substrate.

8. The method of claim 7, further including:

forming a sixth electrical conductor on a first portion of the first major surface of the second flexible electrically insulating substrate, the sixth electrical conductor having a first terminal, a second terminal, and a first annular-shaped portion between the first terminal and the second terminal, wherein a fifth thru-via extends from the second terminal of the sixth electrically conductive trace through the second flexible electrically insulating substrate;

forming a seventh electrical conductor on a second portion of the first major surface of the second flexible electrically insulating substrate, the seventh electrical conductor having a first terminal, a second terminal, a first annular-shaped portion between the first terminal and the second terminal of the seventh electrical conductor, and a second annular-shaped portion between the first terminal and the second terminal of the seventh electrical conductor, wherein the fifth thru-via extends from the first terminal of the seventh electrical conductor through the flexible electrically insulating substrate and a sixth thru-via extends from the second terminal of the seventh electrical conductor through the second flexible electrically insulating substrate;

forming an eighth electrical conductor on a third portion of the first major surface of the second flexible electrically insulating substrate, the eighth electrical conductor having a first terminal, a second terminal, and a first annular-shaped portion between the first terminal and the second terminal of the third electrical conductor, wherein the sixth thru-via extends from the first terminal of the eighth electrical conductor through the second flexible electrically insulating substrate;

forming a ninth electrical conductor on a first portion of the second major surface of the second flexible electrically insulating substrate, the ninth electrical conductor having a first terminal, a second terminal, a first annular-shaped portion between the first terminal and the second terminal of the ninth electrical conductor, and a second annular-shaped portion between the first terminal and the second terminal of the ninth electrical conductor, wherein the sixth thru-via extends from the first terminal of the ninth electrical conductor through the flexible electrically insulating substrate and a seventh thru-via extends from the second terminal of the ninth electrical conductor through the flexible electrically insulating substrate;

forming a tenth electrical conductor on a second portion of the second major surface of the second flexible electrically insulating substrate, the tenth electrical conductor having a first terminal, a second terminal, a first annular-shaped portion between the first terminal and the second terminal of the fifth electrical conductor, and a second annular-shaped portion between the first terminal and the second terminal of the fifth electrical conductor, wherein the seventh thru-via extends from the first terminal of the tenth electrical conductor through the flexible electrically insulating substrate and an eighth thru-via extends from the second terminal of the tenth electrical conductor through the second flexible electrically insulating substrate;

folding the first flexible electrically insulating substrate to have a W-shape;

folding the second flexible electrically insulating substrate to have a W-shape; and inserting portions of the first flexible electrically insulating substrate between portions of the second flexible electrically insulating substrate.

9. A method for manufacturing an inductor, comprising:

providing a first flexible electrically insulating substrate having a first major surface and a second major surface;

forming a first electrically conductive trace on a first portion of the first major surface of the first flexible electrically insulating substrate, the first electrically conductive trace having a first terminal, a second terminal, a first annular-shaped portion, and a second annular shaped portion, the first and second annular shaped portions between the first terminal and the second terminal of the first electrically conductive trace;

forming a first thru-via that extends from the first terminal of the first electrically conductive trace into the first flexible electrically insulating substrate, and a second thru-via that extends from the second terminal of the first electrically conductive trace into the flexible electrically insulating substrate; and folding the first flexible electrically insulating substrate such that the first annular portion of the first electrically conductive trace faces the second annular portion of the first electrically conductive trace.

10. The method of claim 9, further including forming a second electrically conductive trace on a second portion of the first major surface of the first electrically insulating substrate, the second electrically conductive trace having a first terminal, a second terminal, and an annular-shaped portion, the annular shaped portion between the first terminal and the second terminal of the first electrically conductive trace.

11. The method of claim 10, further including forming a third electrically conductive trace on a third portion of the first major surface of the first electrically insulating substrate, the third electrically conductive trace having a first terminal, a second terminal, and an annular-shaped portion, the annular shaped portion of the third electrically conductive trace between the first terminal and the second terminal of the first electrically conductive trace.

12. The method of claim 11, further including forming the second electrically conductive trace and the third electrically conductive trace so that the first electrically conductive trace is between the second electrically conductive trace and the third electrically conductive trace.

13. The method of claim 11, further including forming a fourth electrically conductive trace on a first portion of the second major surface of the first electrically insulating substrate, the fourth electrically conductive trace having a first terminal, a second terminal, a first annular-shaped portion, and a second annular shaped portion, the first and second annular shaped portions between the first terminal and the second terminal of the first electrically conductive trace; and wherein folding the first flexible electrically insulating substrate positions the fourth electrically conductive trace so that the first annular portion of the fourth electrically conductive trace is adjacent to the annular portion of the third electrically conductive trace.

14. The method of claim 13, wherein folding the flexible electrically insulating substrate positions the fourth electrically conductive trace so that the second annular portion of the fourth electrically conductive trace is adjacent to the second annular portion of the first electrically conductive trace.

15. The method of claim 12, further including forming a fifth electrically conductive trace on a second portion of the second major surface of the first electrically insulating substrate, the fifth electrically conductive trace having a first terminal, a second terminal, a first annular-shaped portion, and a second annular shaped portion, the first and second annular shaped portions of the fifth electrically conductive trace between the first terminal and the second terminal of the fifth electrically conductive trace; and wherein folding the flexible electrically insulating substrate positions the fifth electrically conductive trace so that the second annular portion of the fifth electrically conductive trace is adjacent to the annular portion of the second electrically conductive trace.

16. The method of claim 15, further including:

providing a second flexible electrically insulating substrate having a first major surface and a second major surface;

forming a sixth electrically conductive trace on a first portion of the first major surface of the second flexible electrically insulating substrate, the sixth electrically conductive trace having a first terminal, a second terminal, a first annular-shaped portion, and a second annular shaped portion, the first and second annular shaped portions between the first terminal and the second terminal of the sixth electrically conductive trace;

forming a third thru-via that extends from the first terminal of the sixth electrically conductive trace into the second flexible electrically insulating substrate, and a fourth thru-via that extends from the second terminal of the sixth electrically conductive trace into the second flexible electrically insulating substrate;

folding the second flexible electrically insulating substrate such that the first annular portion of the first electrically conductive trace faces the second annular portion of the second electrically conductive trace of the second flexible electrically insulating substrate; and coupling a first portion of the folded second flexible electrically insulating substrate with a first portion of the folded first flexible electrically insulating substrate.

17. The method of claim 16, further including:

forming a seventh electrically conductive trace on a second portion of the first major surface of the second flexible electrically insulating substrate, the seventh electrically conductive trace having a first terminal, a second terminal, and an annular-shaped portion, the annular shaped portion between the first terminal and the second terminal of the seventh electrically conductive trace; and forming an eighth electrically conductive trace on a third portion of the first major surface of the second electrically insulating substrate, the eighth electrically conductive trace having a first terminal, a second terminal, and an annular-shaped portion, the annular shaped portion of the eighth electrically conductive trace between the first terminal and the second terminal of the eighth electrically conductive trace.

18. The method of claim 17, further including forming a ninth electrically conductive trace on a second portion of the second major surface of the second electrically insulating substrate, the ninth electrically conductive trace having a first terminal, a second terminal, a first annular-shaped portion, and a second annular shaped portion, the first and second annular shaped portions of the ninth electrically conductive trace between the first terminal and the second terminal of the ninth electrically conductive trace; and wherein folding the flexible electrically insulating substrate positions the ninth electrically conductive trace so that the second annular portion of the ninth electrically conductive trace is adjacent to the annular portion of the second electrically conductive trace of the second electrically insulating substrate.

19. The method of claim 9, further including:

providing a second flexible electrically insulating substrate having a first major surface and a second major surface;

forming a second electrically conductive trace on a first portion of the first major surface of the second flexible electrically insulating substrate, the second electrically conductive trace having a first terminal, a second terminal, a first annular-shaped portion, and a second annular shaped portion, the first and second annular shaped portions between the first terminal and the second terminal of the second electrically conductive trace;

forming a third thru-via that extends from the first terminal of the second electrically conductive trace into the second flexible electrically insulating substrate, and a fourth thru-via that extends from the second terminal of the second electrically conductive trace into the second flexible electrically insulating substrate;

folding the second flexible electrically insulating substrate such that the first annular portion of the second electrically conductive trace faces the second annular portion of the second electrically conductive trace; and coupling a first portion of the folded second flexible electrically insulating substrate with a first portion of the folded first flexible electrically insulating substrate.

20. The method of claim 19, further including:

providing a third flexible electrically insulating substrate having a first major surface and a second major surface;

forming a third electrically conductive trace on a first portion of the first major surface of the third flexible electrically insulating substrate, the third electrically conductive trace having a first terminal, a second terminal, a first annular-shaped portion, and a second annular shaped portion, the first and second annular shaped portions between the first terminal and the second terminal of the third electrically conductive trace;

forming a fifth thru-via that extends from the first terminal of the second electrically conductive trace into the third flexible electrically insulating substrate, and a second thru-via that extends from the second terminal of the second electrically conductive trace into the third flexible electrically insulating substrate;

folding the third flexible electrically insulating substrate such that the first annular portion of the third electrically conductive trace faces the second annular portion of the third electrically conductive trace; and coupling a first portion of the folded third flexible electrically insulating substrate with a second portion of the folded second flexible electrically insulating substrate.

* * * * *